US012262790B1

(12) United States Patent
Panda

(10) Patent No.: US 12,262,790 B1
(45) Date of Patent: Apr. 1, 2025

(54) CHANGEABLE TOP LIFT HEEL SYSTEM

(71) Applicant: El A. Panda, Chicago, IL (US)

(72) Inventor: El A. Panda, Chicago, IL (US)

( * ) Notice: Subject to any disclaimer, the term of this patent is extended or adjusted under 35 U.S.C. 154(b) by 0 days.

(21) Appl. No.: 18/925,970

(22) Filed: Oct. 24, 2024

(51) Int. Cl.
*A43B 21/42* (2006.01)

(52) U.S. Cl.
CPC ..... *A43B 21/42* (2013.01)

(58) Field of Classification Search
CPC ..... A43B 21/42
See application file for complete search history.

(56) References Cited

U.S. PATENT DOCUMENTS

| | | | | |
|---|---|---|---|---|
| 1,220 | A | 7/1839 | Duntze | |
| 784,650 | A | 3/1905 | Zarwell et al. | |
| 1,172,919 | A | 2/1916 | Weber | |
| 1,230,510 | A | 6/1917 | Philp | |
| 1,400,096 | A | 12/1921 | Owen | |
| 1,624,913 | A | 4/1927 | Ames | |
| 1,691,064 | A | 11/1928 | Hoppe | |
| 1,742,894 | A | 1/1930 | Bono | |
| 1,854,057 | A | 4/1932 | Norris | |
| 1,977,777 | A | 10/1934 | Rhodes | |
| 2,037,613 | A | 4/1936 | Book | |
| 2,050,644 | A | 8/1936 | Book et al. | |
| 2,070,595 | A | 2/1937 | Haider | |
| 2,143,897 | A | 1/1939 | Oriola | |
| 2,263,186 | A | 11/1941 | Parkhurst | |
| 2,266,575 | A | 12/1941 | Treece | |
| 2,523,652 | A | 9/1950 | Dowd et al. | |
| 2,548,194 | A | 4/1951 | Buechler | |
| 2,807,100 | A | 9/1957 | Windle | |
| 2,875,532 | A | 3/1959 | Fitzsimmons | |
| 2,923,071 | A | 2/1960 | Whitted | |
| 2,925,671 | A | 2/1960 | Del Giudice et al. | |
| 2,934,840 | A * | 5/1960 | Mistarz | A43B 21/437 D2/966 |
| 2,935,799 | A | 5/1960 | Ronci | |
| 2,937,461 | A | 5/1960 | Trela | |
| 2,940,186 | A * | 6/1960 | Boldt | A43B 21/46 36/42 |
| 3,034,234 | A | 5/1962 | Portelli | |
| 3,040,452 | A | 6/1962 | Whitted, Jr. | |
| 3,041,744 | A | 7/1962 | Brauner | |
| 3,043,024 | A | 7/1962 | Haug, Jr. | |
| 3,055,125 | A | 9/1962 | Ronci | |

(Continued)

FOREIGN PATENT DOCUMENTS

EP 2143354 B1 5/2012

*Primary Examiner* — Ted Kavanaugh
(74) *Attorney, Agent, or Firm* — Ice Miller LLP; Justin Swindells

(57) ABSTRACT

A footwear heel assembly coupling a top lift and heel, comprises a shaft having opposite ends, a top lift insert coupled to the top lift, a heel insert positioned in the heel, a stop positioned in the heel, and a compressible elastic member positioned in the heel between the heel insert and the stop. The shaft ends are received in the top lift insert and stop. The top lift insert and the heel insert are slidingly coupled by the shaft, and have complementary teeth configured for interlocking engagement. The compressible elastic member biases the stop away from the heel insert, and urges the top lift insert teeth toward interlocking engagement with the heel insert teeth which prevents rotation of the top lift relative to the heel.

20 Claims, 28 Drawing Sheets

(56) References Cited

U.S. PATENT DOCUMENTS

| | | | | | |
|---|---|---|---|---|---|
| 3,074,187 | A | | 1/1963 | Klein | |
| 3,079,709 | A | | 3/1963 | Yankov | |
| 3,106,791 | A | | 10/1963 | Ball | |
| 3,119,192 | A | | 1/1964 | Ronci | |
| 3,133,362 | A | | 5/1964 | Faccin | |
| 3,134,180 | A | | 5/1964 | Stone | |
| 3,152,408 | A | | 10/1964 | Thiessen | |
| 3,178,835 | A | | 4/1965 | Burke et al. | |
| 3,182,409 | A | | 5/1965 | Herremans | |
| 3,196,560 | A | | 7/1965 | Powell | |
| 3,200,518 | A | | 8/1965 | Rasmussen | |
| 3,225,465 | A | | 12/1965 | Ball | |
| 3,237,321 | A | | 3/1966 | McKinley | |
| 3,266,177 | A | | 8/1966 | Holden | |
| 3,473,241 | A | * | 10/1969 | Parma | A43B 21/42 36/42 |
| 3,514,879 | A | | 6/1970 | Frattallone | |
| 3,805,418 | A | | 4/1974 | Matuka et al. | |
| 3,890,725 | A | | 6/1975 | Lea et al. | |
| 3,977,095 | A | | 8/1976 | Phillips | |
| 4,041,618 | A | | 8/1977 | Famolare, Jr. | |
| 4,198,770 | A | | 4/1980 | Orea Mateo | |
| 4,272,897 | A | | 6/1981 | Ponce | |
| 4,403,426 | A | * | 9/1983 | Kaplan | A43B 21/42 36/35 A |
| 4,424,635 | A | | 1/1984 | Jourdan | |
| 4,494,323 | A | | 1/1985 | Latraverse | |
| 4,670,996 | A | | 6/1987 | Dill | |
| 4,729,178 | A | | 3/1988 | Bouchet | |
| 4,805,320 | A | | 2/1989 | Goldenberg et al. | |
| 4,819,344 | A | | 4/1989 | Schuller | |
| 4,848,008 | A | | 7/1989 | Kuehnle et al. | |
| 4,907,351 | A | | 3/1990 | Hirai | |
| 4,922,629 | A | | 5/1990 | Bouchet | |
| 4,924,607 | A | | 5/1990 | Harper | |
| 4,953,310 | A | | 9/1990 | Haug | |
| 5,025,574 | A | | 6/1991 | Lasher, III | |
| 5,058,290 | A | | 10/1991 | Koehl et al. | |
| 5,063,691 | A | | 11/1991 | Haug | |
| 5,079,857 | A | | 1/1992 | Clifton | |
| 5,325,612 | A | | 7/1994 | Lock et al. | |
| 5,524,365 | A | | 6/1996 | Goldenberg | |
| 5,581,910 | A | | 12/1996 | Lewis | |
| 5,626,449 | A | | 5/1997 | McKinlay | |
| 5,655,317 | A | | 8/1997 | Grant | |
| 6,021,586 | A | | 2/2000 | Bucalo et al. | |
| 6,023,858 | A | | 2/2000 | Srourian | |
| 6,442,872 | B1 | | 9/2002 | Liao | |
| 6,467,198 | B1 | | 10/2002 | James | |
| 6,631,570 | B1 | | 10/2003 | Walker | |
| 6,895,695 | B1 | | 5/2005 | Chen | |
| 7,059,068 | B2 | | 6/2006 | Magallanes et al. | |
| 7,140,125 | B2 | | 11/2006 | Singleton et al. | |
| 7,578,075 | B1 | | 8/2009 | Kemp | |
| 7,735,240 | B2 | | 6/2010 | Lee | |
| 8,112,908 | B2 | | 2/2012 | Visser | |
| 8,132,341 | B1 | | 3/2012 | Laramore | |
| 8,365,439 | B2 | | 2/2013 | Koh | |
| 8,511,954 | B2 | | 8/2013 | Fink et al. | |
| 8,832,972 | B2 | | 9/2014 | Kemp | |
| 8,925,218 | B2 | | 1/2015 | Anderson | |
| 9,220,317 | B2 | | 12/2015 | Green | |
| 9,226,547 | B2 | | 1/2016 | Pitcock et al. | |
| D774,291 | S | | 12/2016 | Archambeaud | |
| 9,781,973 | B2 | | 10/2017 | Singh et al. | |
| 11,297,900 | B2 | | 4/2022 | Yangas | |
| 11,523,659 | B2 | | 12/2022 | Yangas | |
| 11,957,209 | B2 | | 4/2024 | Panda | |
| 2001/0034957 | A1 | | 11/2001 | Doerer et al. | |
| 2003/0074807 | A1 | | 4/2003 | Sato et al. | |
| 2005/0160629 | A1 | | 7/2005 | Jungkind | |
| 2006/0156518 | A1 | | 7/2006 | Frank | |
| 2006/0213082 | A1 | | 9/2006 | Meschan | |
| 2006/0218820 | A1 | | 10/2006 | Baden et al. | |
| 2008/0034620 | A1 | | 2/2008 | Gallegos | |
| 2008/0134542 | A1 | | 6/2008 | Shih | |
| 2008/0235991 | A1 | | 10/2008 | Visser | |
| 2008/0244931 | A1 | | 10/2008 | Gallegos | |
| 2009/0199375 | A1 | | 8/2009 | Koelling et al. | |
| 2010/0139123 | A1 | | 6/2010 | Alan et al. | |
| 2013/0019498 | A1 | | 1/2013 | Causey et al. | |
| 2013/0025165 | A1 | | 1/2013 | Hunter et al. | |
| 2013/0255110 | A1 | | 10/2013 | Jang | |
| 2013/0312285 | A1 | | 11/2013 | Sharma et al. | |
| 2014/0033578 | A1 | | 2/2014 | Moehring | |
| 2014/0082972 | A1 | | 3/2014 | Jones | |
| 2014/0196319 | A1 | | 7/2014 | Rupprecht | |
| 2014/0290100 | A1 | | 10/2014 | Flowers | |
| 2015/0075032 | A1 | | 3/2015 | Skrepenski | |
| 2015/0272272 | A1 | | 10/2015 | Scofield | |
| 2017/0347751 | A1 | | 12/2017 | Leiber | |
| 2019/0029367 | A1 | * | 1/2019 | Yangas | A43B 21/30 |
| 2020/0029654 | A1 | * | 1/2020 | Yangas | A43B 21/42 |

* cited by examiner

CHANGEABLE TOP LIFT HEEL SYSTEM

FIELD OF THE INVENTION

The present disclosure relates to high heel footwear, and more particularly to a heel system having removable top lift to facilitate replacement.

BACKGROUND

Existing designs of the heel tip for a high heel have many drawbacks and flaws, including the materials used, design and engineering of the heel tip, and how it is attached to the heel. Heel tips are used for protection against the severe abrasive pressure on the heel during normal walking. Various types of heel tips have been devised, but at the present time, conventional heel tips consist of a hard polyurethane or plastic/rubber mix molded around a metal nail head with the nail stem protruding beyond the polyurethane material. To securely fasten the heel tip to the heel, the nail stem is driven into a bore extending along the inside of the heel.

A large amount of stress and pressure is concentrated on a heel tip from the impact against the ground, especially when walking on uneven or high-friction surfaces such as concrete. Such forces, coupled with the small surface area of the heel, often cause heel tips to wear out or get pulled out of or dislodged from the heel within a few weeks of wear.

When heel tips need to be replaced, most people delay the replacement and continue to walk on worn out heel tips, sometimes wearing the heel tips away completely until remnants of the metal nail head are all that remain. Walking on worn out heel tips involves a variety of adverse and potentially dangerous side effects.

First, the harmful shock waves that are transmitted through the body as the metal nail head hits the surface can cause damage ranging from the feet all the way up to the neck. Second, the nail head can mark, scrape and damage floors. Also, the metal nail head is very smooth, which increases the risk of slipping or falling while walking. As a result, walking on a worn-out heel tip can cause damage to the heel by fraying, erosion, and other destruction from friction. Lastly, the exposed metal nail makes a loud, distinct clicking sound as it strikes the ground during walking which is audibly distracting to the wearer and to others.

Aspects of the present disclosure overcome these and other problems.

BRIEF SUMMARY

Aspects of the present disclosure solve or overcome at least the above-stated problems and disadvantages. Currently, there is no commercially available heel tip that does not wear out within a few weeks of use. A wearer must or ought to replace the heel tips, on average, every 30 days if that heel tip can even stay attached to the heel that long. An objective of aspects of the present disclosure is to provide a stronger heel tip that can take years of use and abuse before it starts to deteriorate, cannot get pulled out of the heel when worn and used and will help to absorb the harmful shock waves that are sent throughout the entire body with every step.

The heel tip is made of longer-wearing, resilient materials. One of these materials protects the body from the harmful shockwaves that are caused by every step, jump or stride that the high-heel wearer takes. It has been demonstrated in several studies that the rubber material of this invention stops the harmful shock waves that accumulate over time as damage to the body from our feet to the base of our skull from the repeated exposure the shock waves caused by daily activity.

Conventional heel tips are made of solid polyurethane, which does not deter the damage from the exposure of the shock waves that can cause numerous chronic injuries. By contrast, according to the present disclosure, some aspects provide a micro honeycomb internal structure in the heel tip to decrease the shock waves the body is absorbing as the high-heel wearer walks, runs or jumps. The micro honeycomb significantly decreases both the amplitude of the high frequency forces and their ability to propagate up into the body thus eliminating chronic pain and injuries that can diminish the high-heel wearer's ability to function at a normal level.

Furthermore, conventional heel tips have a nail or a steel pin that protrudes from the polyurethane material and is hammered or driven into the bore of the heel to hold the heel tip in place against the heel. By contrast, aspects of the present disclosure provide various combinations of anti-rotation, securing, and alignment promoting features to prevent rotation or slippage of the heel tip, secure the heel tip to the heel in a fixed, unmovable manner, and align the heel tip to the heel. According to some aspects of the present disclosure, a threaded insert or expansion anchor can be set in the heel and the heel tip, which can include a square or propeller head screw, with the micro honeycomb structure, is then rotated until the threaded insert locks the screw into place or the expansion anchor opens, locking the screw and heel tip securely into the heel. Optionally, the heel tip can be removed easily, by counter-rotating it, for example, to replace it with a new one or swap it entirely out for a different style.

Some removable heel tip designs may be susceptible to inadvertent rotation of the heel tip relative to the heel, causing misalignment of the heel tip and heel. Inadvertent rotation and misalignment of the heel tip is not only aesthetically undesirable, but may also increase wear or damage to the attachment of the heel tip, and may increase the risk of injury to the user from tripping or slipping. Therefore, it would be desirable to provide a removable heel tip with a reversible locking feature that secures and prevents the inadvertent rotation the heel tip relative to the heel.

According to an aspect of the present disclosure, a heel system for coupling a heel and a top lift of a footwear is disclosed. The heel system comprises a top lift insert, a heel insert, and shaft. The top lift insert is coupled to the top lift, and comprises a plurality of spaced first teeth. The heel insert is coupled to the heel, and comprises a plurality of spaced second teeth that are complementary to the first teeth. The shaft rotatably couples the top lift insert and the heel insert, and the heel insert is slidable on the shaft to reversibly engage the first teeth with the second teeth. The top lift insert cannot rotate relative to the heel insert when the first teeth are engaged with the second teeth.

In another embodiment, a heel system for a footwear comprises a top lift, a heel, and a heel assembly. The top lift has a cavity. The heel has a heel bore. The heel assembly couples the top lift and the heel, and comprises a shaft, a top lift insert, a heel insert, a stop, and a compressible elastic member. The shaft has opposite shaft first and second ends. The top lift insert is coupled to the top lift, and comprises a base received in the top lift cavity, a first bore sized and shaped to receive the shaft first end, and a plurality of spaced first teeth. The heel insert is positioned in the heel bore, and comprises a channel, heel insert first and second ends, and a plurality of spaced second teeth positioned at the heel insert first end. The channel extends through the heel insert and is sized and shaped to slidably receive the shaft. The second teeth are complementary to the first teeth. The stop is positioned in the heel bore and has a stop bore that is sized and shaped to receive the shaft second end. The compressible elastic member is positioned in the heel between the heel insert second end and the stop. The compressible elastic member biases the stop away from the heel insert and urges the first teeth toward engagement with the second teeth. The top lift and heel are rotatably coupled by the shaft, the heel insert is slidable on the shaft to reversibly engage the first teeth with the second teeth, and the top lift cannot rotate relative to the heel when the first teeth are engaged with the second teeth.

DETAILED DESCRIPTION

Figure 1:
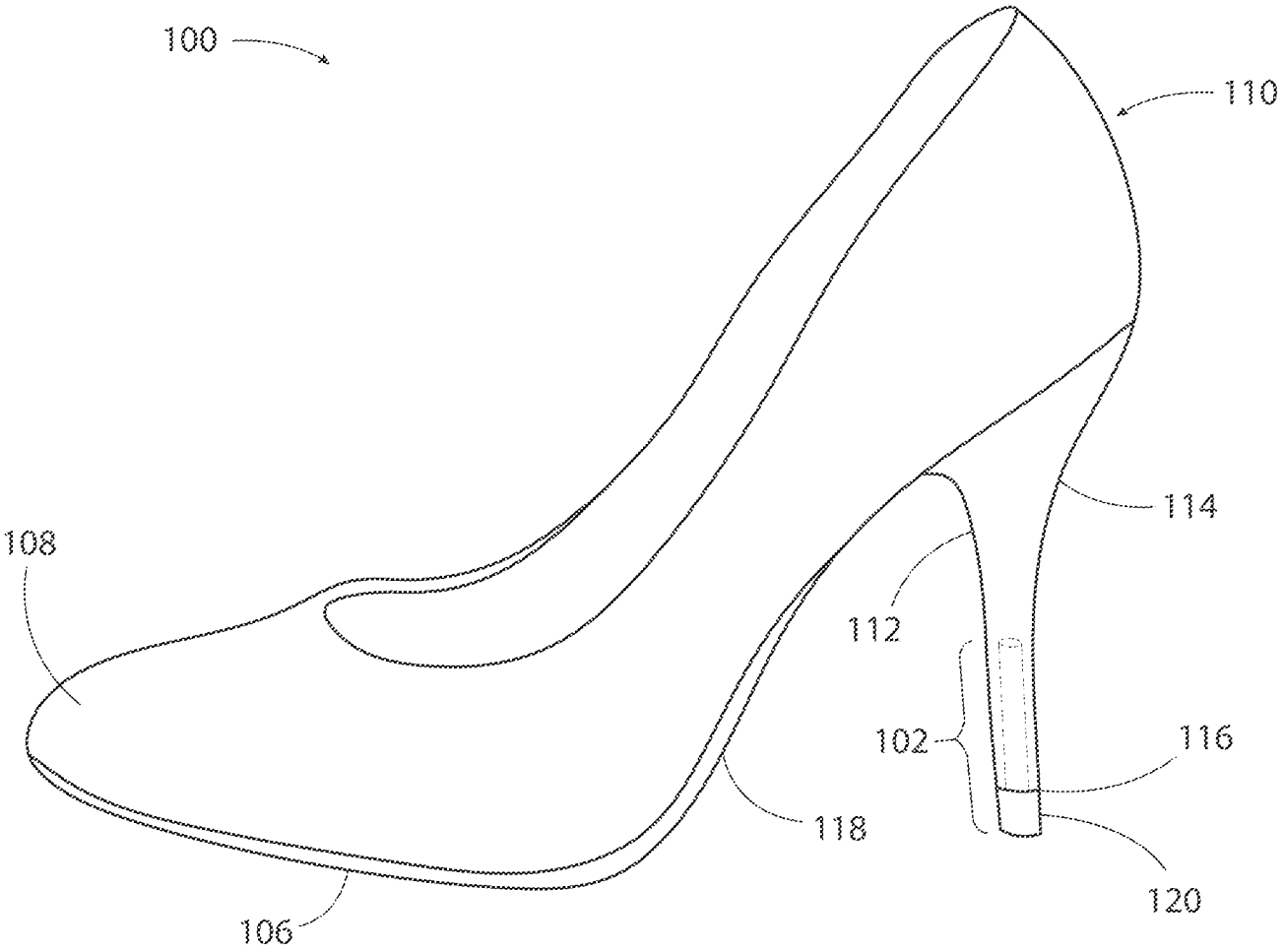
FIG. 1 is a perspective view of an example high heel footwear having a relatively narrow heel that incorporates a heel tip assembly according to an aspect of the present disclosure.

FIG. 1 is a perspective view of an example high heel footwear 100 having a relatively narrow heel that incorporates a heel tip assembly 102 according to an aspect of the present disclosure. The term "footwear" encompasses shoes, boots, sandals, flip flops, and any other apparatus worn on the foot and designed or intended to be worn by either men or women or both. The term "high heel" has its ordinary meaning to those skilled in the art of footwear, and those of ordinary skill in the art of footwear will appreciate the dimensions and characteristics of a footwear item having a high heel. For example, stiletto type heels can have a heel height of about 4-6 inches or even higher. Squatter, high heel boots (including those worn by men), for example, can have a heel height of about 3-4 inches. According to some aspects, a minimum heel height to qualify as a high heel is about 2 inches. The present disclosure also contemplates so-called platform footwear, so long as there is a distinct outsole portion and distinct heel portion. As shown in FIG. 1, the various parts of a high heel footwear 100 are conventionally labeled as an outsole 106, a toe box 108, a counter 110, a breast 112 of the heel, a heel 114, a seat 116, a shank 118, and a top lift 120. The top lift 120 can variously also be referred to as the top piece, the heel tip, the heel lift, or the heel cap, and these terms are used interchangeably herein. The width of the top lift 120 can vary, from narrow in the case of a stiletto heel, to relatively wide as used on a boot or a platform shoe, and aspects of the present disclosure can be used on any top lift 120, from narrow to wide.

For reading convenience, the same reference numbers are used throughout this disclosure to refer to the same item or feature even though they might appear in different embodiments. Where that item or feature differs, a different reference number or an apostrophe is used to indicate that the disclosure is describing a different item or feature. The terms used in this description have their ordinary meaning as understood by those skilled in the art of footwear, tire technology, and mechanical devices.

Figure 2:
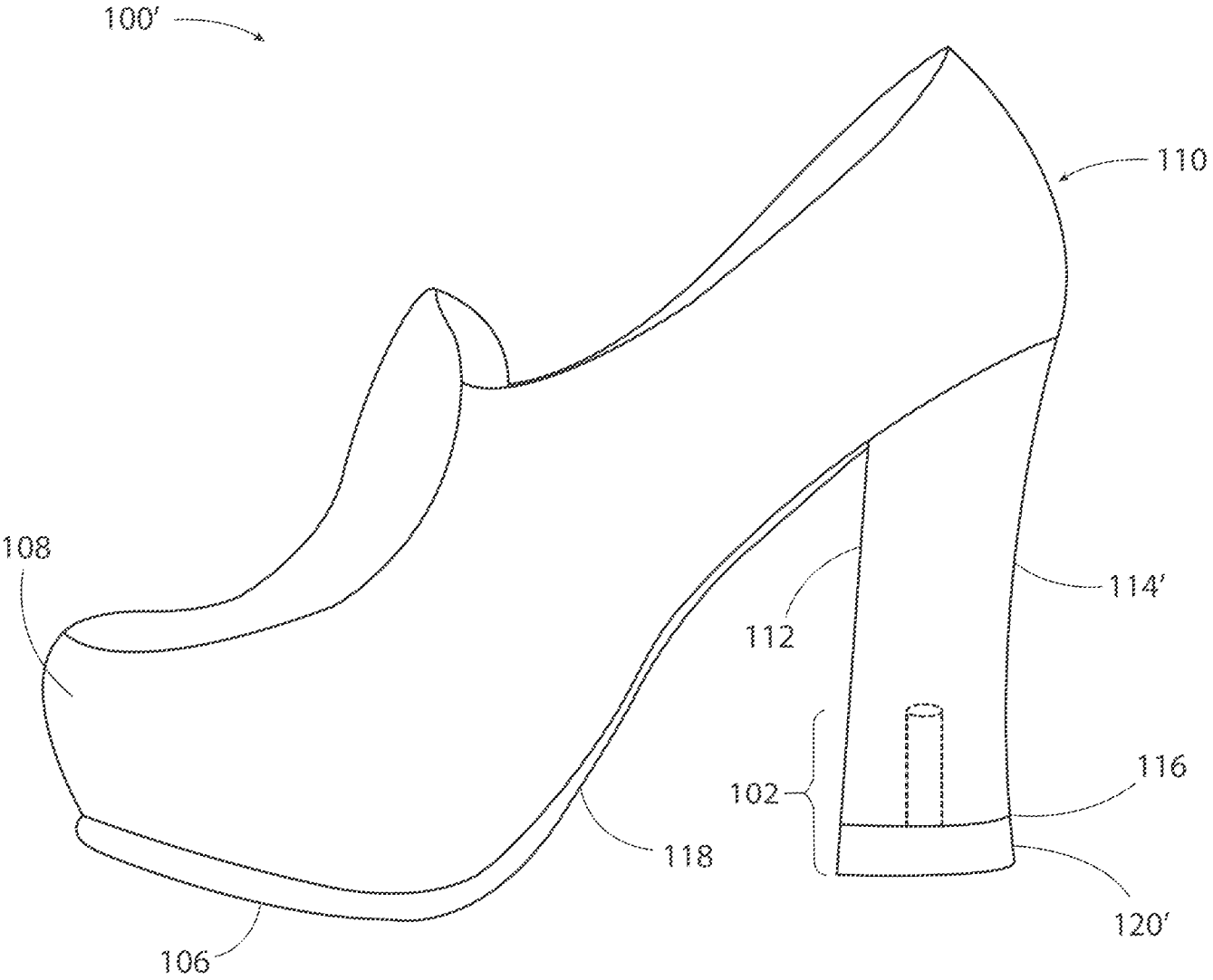
FIG. 2 is a perspective view of another example high heel footwear having a wider heel compared to the high heel footwear shown in FIG. 1, and which incorporates a heel tip assembly according to another aspect of the present disclosure.
Figure 14:
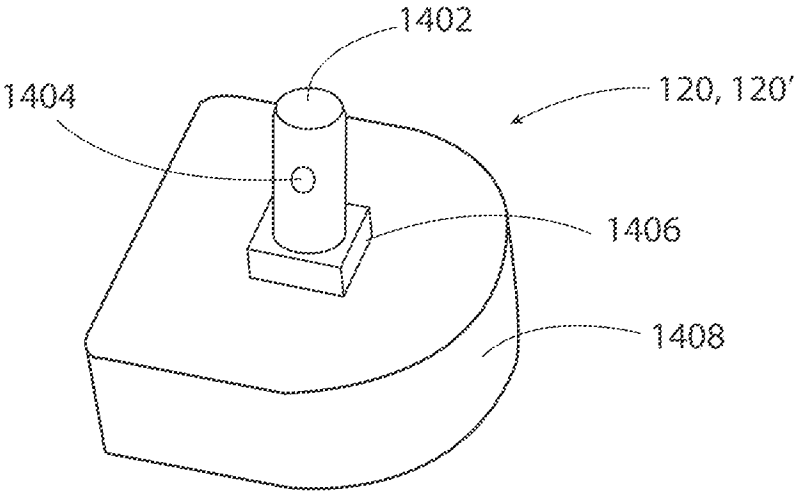
FIG. 14 shows two example isometric views of the top lift disclosed in connection with FIGS. 13A and 13B.
Figure 14:
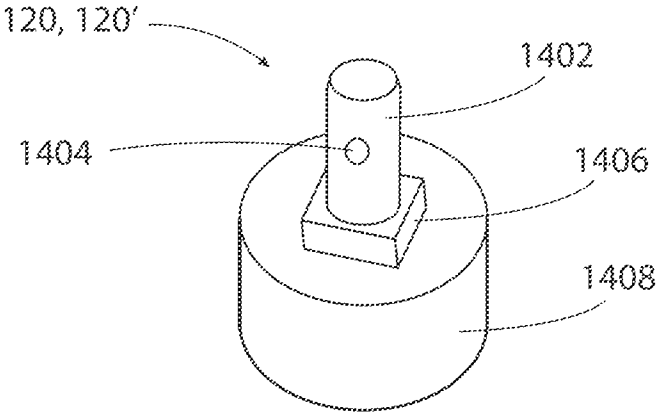

FIG. 2 is a perspective view of another example high heel footwear 100' having a wider heel 114' compared to the high heel footwear shown in FIG. 1, and which incorporates a heel tip assembly 102' according to another aspect of the present disclosure. The same reference numbers are used to refer to the same parts. The high heel footwear 100' has a thicker heel 114' compared to the heel 114 of the high heel footwear 100 shown in FIG. 1. The cross-section of the heel 114, 114' can be regular, such as circular such as shown in FIGS. 14 and 16A, or irregular such as shown in FIGS. 14 and 16B. Throughout this disclosure, for reading convenience, each heel tip assembly 102, 102' will be referred to with these reference numbers even though different embodiments may be described.

Figure 3B:
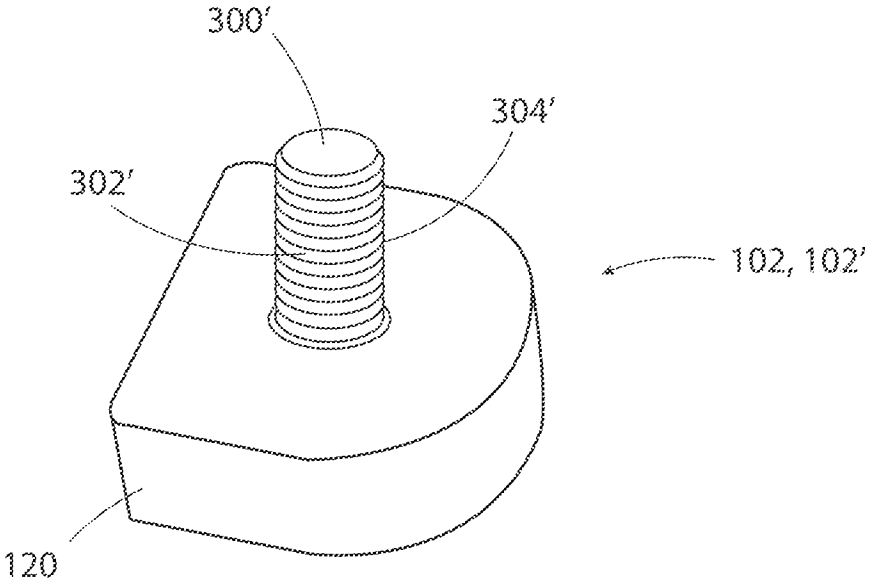
FIGS. 3A and 3B illustrate two different sized heel tip assemblies according to an aspect of the present disclosure.
Figure 3A:
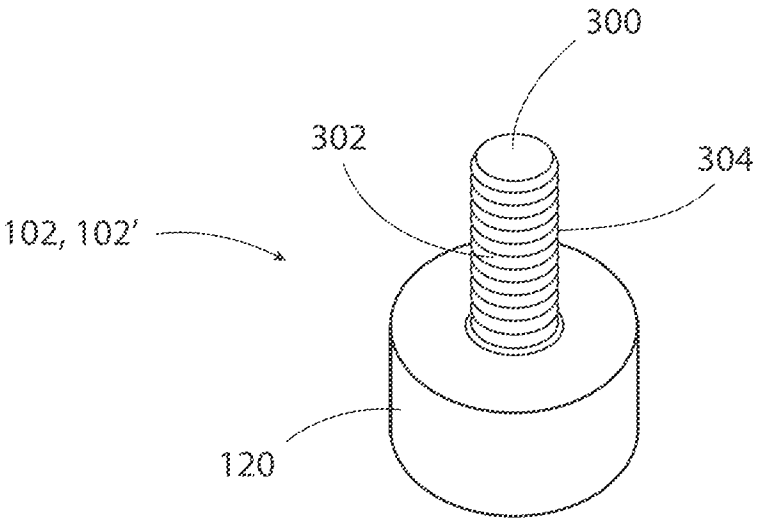

FIGS. 3A and 3B illustrate two different sized heel tip assemblies 102, 102' according to an aspect of the present disclosure. The heel tip assembly 102, 102' generally includes a securing feature part 300, 300', respectively. In this example, the securing feature takes the form of threads 302. Generally, a securing feature refers to a feature, such as a tangible feature, that permanently or removably secures one part to another in a manner that inhibits movement (by rotation, twisting, or otherwise) of the two parts relative to each other. The securing feature part 302, 302' also has a shaft portion those threads 302, 302' are threaded by rotation into a corresponding threaded insert inside the heel 114, 114' as described herein. In FIG. 3B, the top lift 120' of the heel tip assembly 102' has an irregular contour to match the contour of the heel 114' to which the top lift 120' is secured. As described here, an alignment feature can also be present to ensure that the contours of the top lift and the heel co-align. As the top lift 120' is screwed into place, depending on the alignment of the threads, the top lift 120' may have a tendency to stop rotating at a point where its outer contour is misaligned relative to the heel 114'. To avoid this scenario, various aspects of the present disclosure describe alignment features that aid in co-aligning the top lift with the heel in a facile way during assembly or construction of the footwear 100, 100'.

Figure 4A:
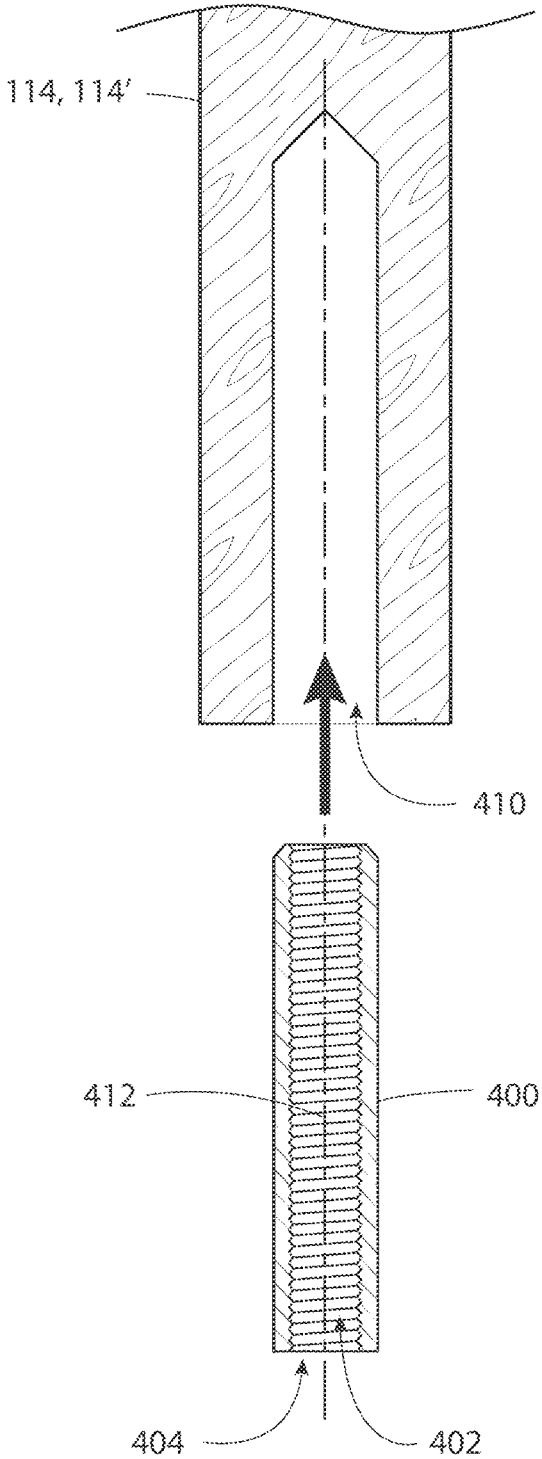
FIG. 4A illustrates an exemplary elongated threaded insert having a hole or bore through the center of a threaded insert, which is inserted into a heel according to aspects of the present disclosure.
Figure 4B:
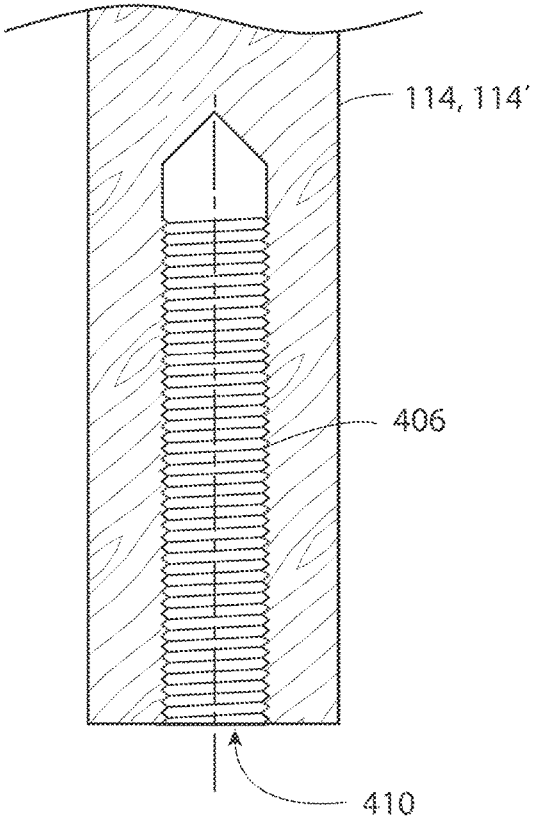
FIG. 4B illustrates an example threaded hole or bore formed within or tapped into the heel with threads to receive threads of a top lift according to aspects of the present disclosure.

Turning now to the heel side of the footwear, FIG. 4A illustrates an exemplary elongated threaded insert 400 having a hole or bore 402 through the center of a threaded insert 400, which is inserted through a hole or bore 410 of the heel 114, 114'. The threaded insert 400 is inserted into the hole or bore 410 of the heel 114, 114' so that an end opening 404 of the threaded insert 400 can receive the securing feature part 300, 300' of a heel tip assembly 102, 102'. The threaded insert 400 can be secured to the heel 114, 114' by glue or interference fit, for example. Alternately, in FIG. 4B, a threaded hole or bore 410 is formed within or tapped into the heel 114, 114' with threads 406 that are configured to receive the threads 302 of the securing feature part 300, 300'.

Figure 5A:
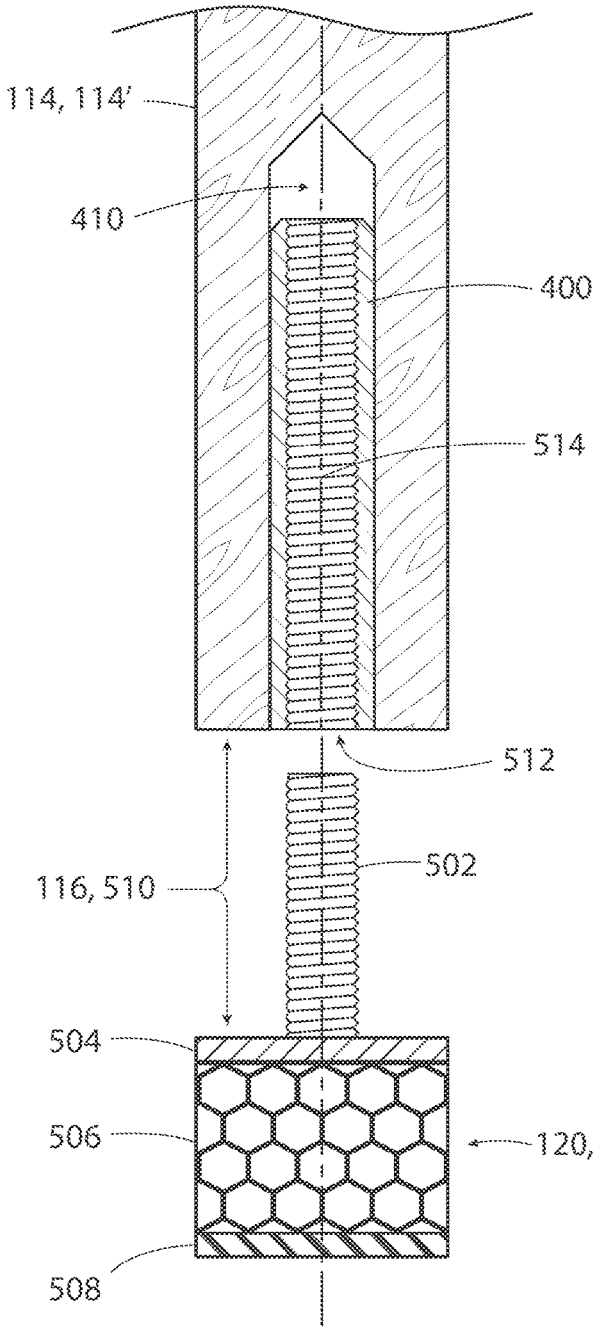
FIGS. 5A and 5B illustrate two example implementations of a heel tip assembly having a top lift with a honeycomb or micro honeycomb pattern made from tire material.
Figure 5B:
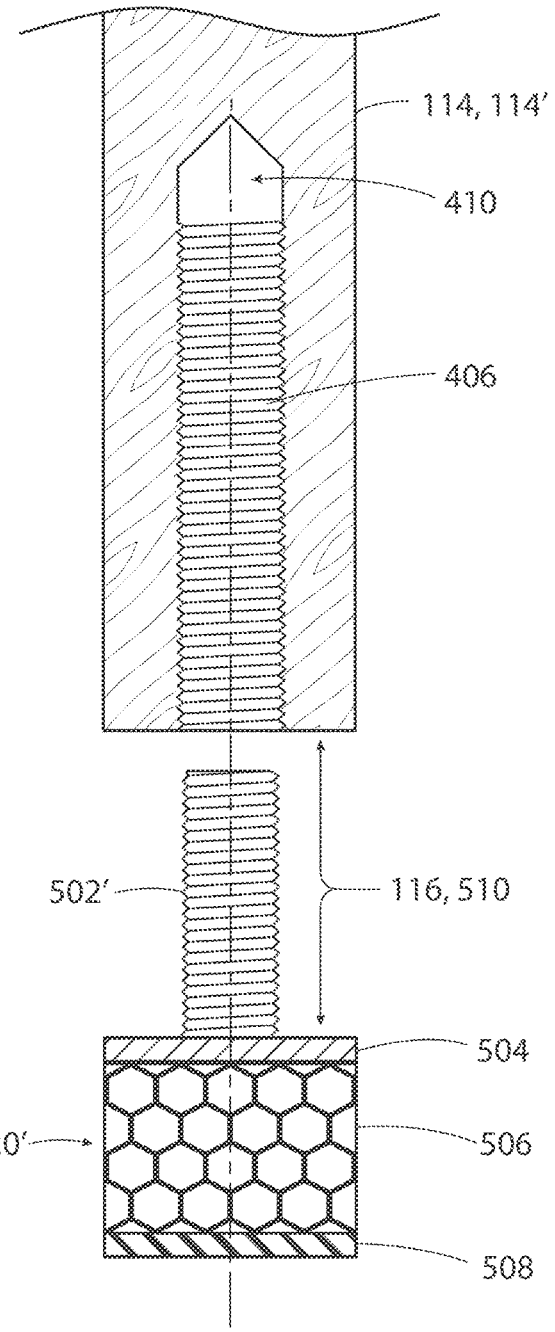

FIGS. 5A and 5B illustrate two example implementations of a heel tip assembly 102, 102' having a top lift 120, 120' with a honeycomb or micro honeycomb pattern made from tire material, including a rubber compound and fillers such as fiber or textiles. Any of the honeycomb or micro honeycomb patterns or structures disclosed herein can be printed by a 3D printing technique, such as digital light synthesis. The top lift 120, 120' has a base portion 504, a central portion 506, and a top portion 508. The cross-section of the central portion 506 has a honeycomb pattern. The illustrations are not schematic representations of the actual honeycomb pattern. Indeed, the honeycomb pattern is shown for ease of illustration so that the reader can readily see the pattern; however, the size of the honeycombs can vary from the size actually shown. For example, the honeycombs can be made larger, or the walls of the honeycomb can be thicker. The honeycomb pattern allows the top lift 120, 120' to compress or deform slightly under load, and more so than if the top lift 120, 120' were made from a solid material such as rubber. The honeycombs of the pattern are arranged to so as to compress along a vertical direction when a load is presented at the top of the honeycomb, thereby providing a cushioning effect to the wearer of the high heel footwear. The top portion 508 (i.e., the part that contacts the ground surface) can be a tire tread material or composed of solid rubber having a tread-like pattern facing the ground to enhance the grip and friction coefficient relative to the ground surface. The base portion 504 can be composed of, for example, metal, such as the same metal as a threaded shaft 502 that extends away from the base portion 504, and the central portion 506 can be secured or attached permanently to the base portion 504 by an adhesive or any other conventional process to permanently affix the two different interface materials together. Another interface 510 is present between the exposed surface of the base portion 504 and the exposed surface of the bottom of the heel 114, 114' before the top lift 120, 120' is secured to the heel 114, 114'. At this interface, an adhesive or other method of permanently affixing the base portion 504 to the bottom of the heel 114, 114' can be used after the securing feature in the form of a threaded shaft 502, 502' is screwed into the corresponding threaded insert 400 or threads 406 inside the bore 410 of the heel 114, 114'. As the wearer walks with the heel top assembly 102, 102' installed in the footwear 100, 100', the honeycomb structure of the central portion 506 will compress and bulge outwardly, providing a soft cushion for the wearer and absorb and dissipate shock waves emitted each time the top portion 508 contacts the ground surface.

Example dimensions of the top lift 120, 120' are as follows. The length, width, or diameter of the top lift 120, 120' match the corresponding length, width, or diameter of the heel 114, 114' to which the heel tip assembly 102, 102' is attached so that the outer contour of the heel at the interface 116 matches the outer contour of the top lift 120, 120'. Beyond the interface, the contour of the top lift 120, 120' can diverge from that of the heel 114, 114'. For example, the top lift 120, 120' can flare outwardly or taper inwardly starting from the interface 116 toward the top portion 508.

Figure 6A:
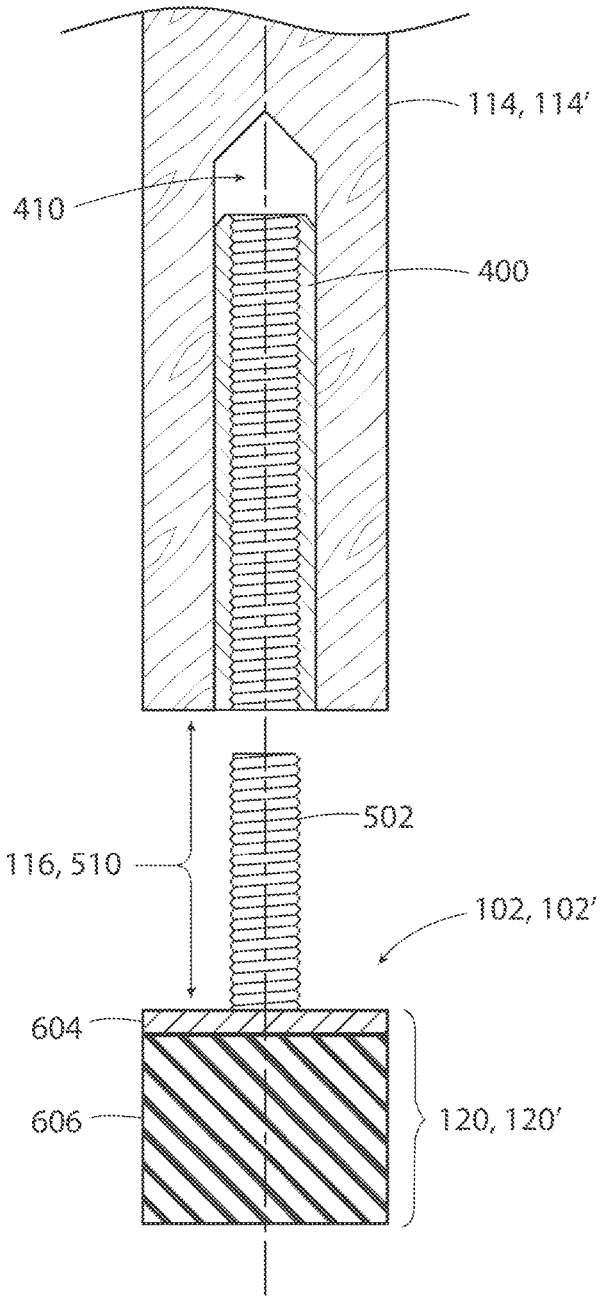
FIG. 6A illustrates a heel having a threaded shaft 502 threaded into a threaded insert that is secured into a hole or bore of a heel.
Figure 6B:
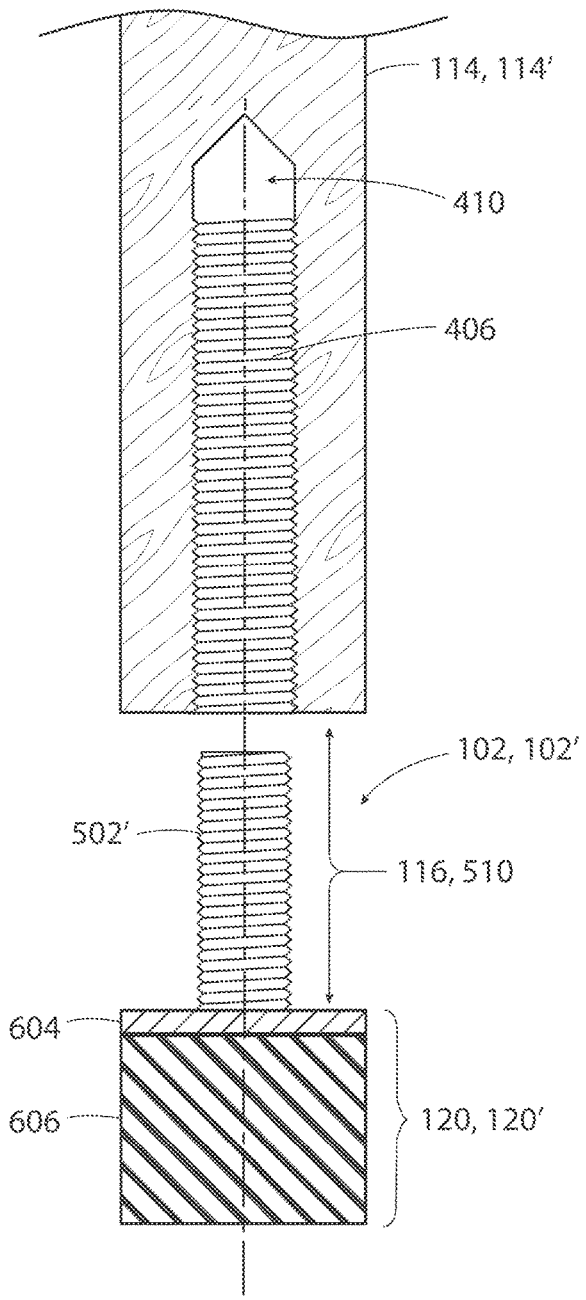
FIG. 6B illustrates a heel having a threaded shaft threaded into the threaded hole or bore that is tapped into the heel

FIGS. 6A and 6B illustrate two examples where the top lift 120, 120' has a top portion 606 made of a solid rubber material that is glued or otherwise permanently affixed to a base portion 604 of a heel tip assembly 102, 102'. The base portion 604 can be made of the same material as the threaded shaft 502, such as metal, to form an anti-rotation feature and a securing feature for the top lift 120, 120'. The outer contour of the base portion 604 and the top portion 606 matches the outer contour of the exposed end of the heel 114, 114' at the interface 116, 510 so that at the interface 116, 510, there is no perceptible discontinuity from the heel 114, 114' to the top lift 606. In FIG. 6A, the threaded shaft 502 is threaded into the threaded insert 400 that is secured into the hole or bore 410 of the heel 114, 114'. In FIG. 6B, the threaded shaft 502' is threaded into the threaded hole or bore 410 that is tapped into the heel 114, 114' with threads 406 that are configured to receive the threads of the threaded shaft 502', which provides a securing feature and an anti-rotation feature relative to the heel 114, 114'. This embodiment is particularly suited for thicker diameter heels, such as the heel 114' shown in FIG. 2.

Figure 7A:
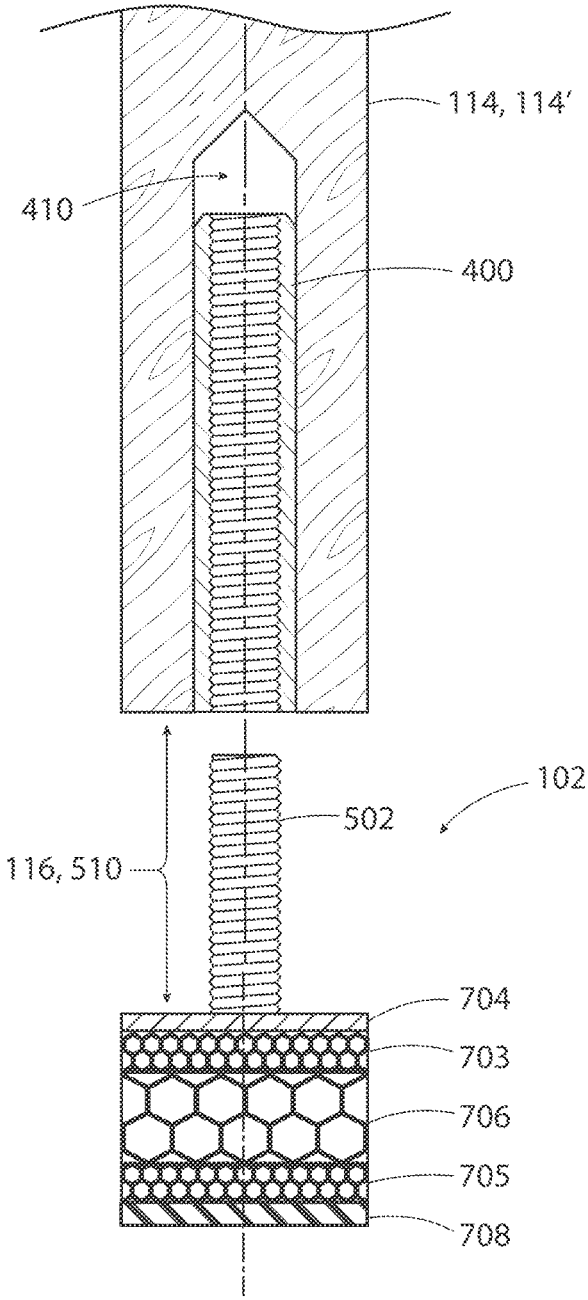
FIGS. 7A and 7B illustrate two examples of a heel tip assembly having a top lift including two types of honeycomb patterns.
Figure 7B:
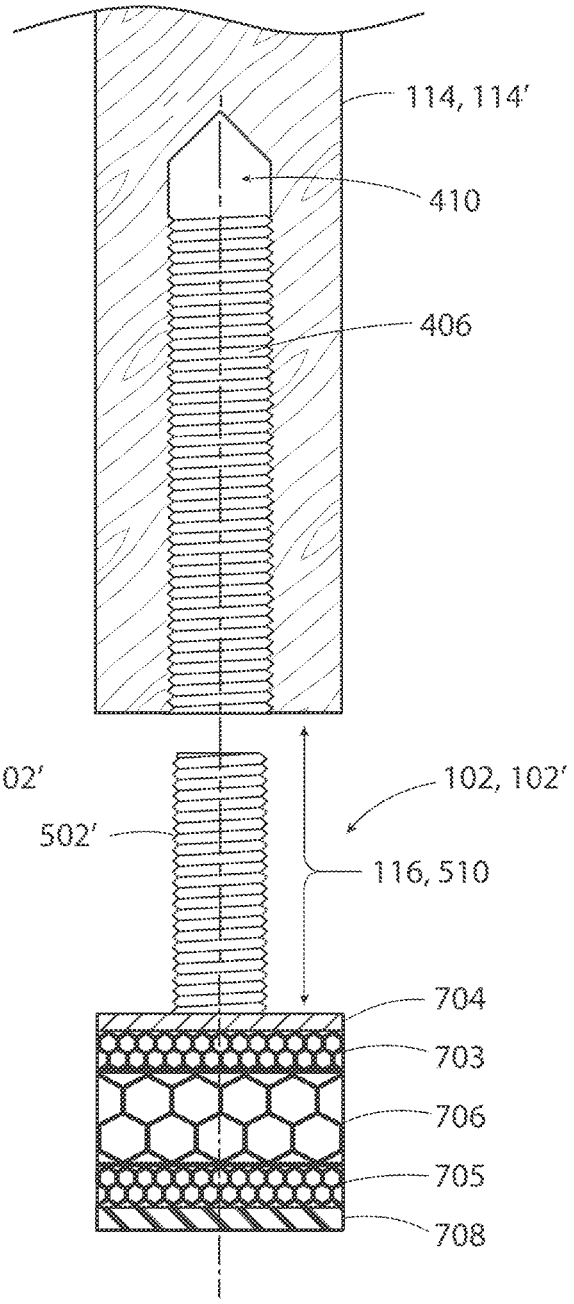

FIGS. 7A and 7B illustrate two examples of a heel tip assembly 102, 102' having a top lift including two types of honeycomb patterns 703, 705, 706 such as shown as honeycomb pattern 506 in FIGS. 5A and 5B. The top lift has a central portion 706 made from a tire material and having a honeycomb pattern. On either side of the central portion 706, there are encapsulating portions 703, 705 also made from a tire material and having a denser honeycomb pattern compared to that of the central portion 706. Thus, the central portion 706 has more "give" under compression, whereas the denser surrounding encapsulating portions 703,705 have less give, thereby providing more cushioning against shocks and vibrations that would otherwise be transmitted up the leg of the wearer. The top portion 708 can be made of a tire tread material or composed of solid rubber having a tread-like pattern facing the ground to enhance the grip and friction coefficient relative to the ground surface and to provide a softer or quieter interface with the surface on which the footwear is traversing compared to conventional materials used for a high heel top. A base portion 704 fixed to the encapsulating portion 703 can be composed of, for example, metal, such as the same metal as a threaded shaft 502 that extends away from the base portion 704, and the encapsulating portion 703 can be secured or attached permanently to the base portion 704 by an adhesive or any other conventional process to permanently affix the two different interface materials together. The threaded shaft 502 is screwed into an elongated threaded insert 400 having a hole or bore 402 through the center of a threaded insert 400, which is inserted through a hole or bore 410 of the heel 114, 114', to form an anti-rotation feature and a securing feature. When fully screwed in place at the interface 116, 510, the outer contour of the top lift matches an outer contour of the heel 114, 114' at the interface 116, 510 so that no visual discontinuities can be perceived. The colors of the top lift and heel can also be matched to further the visual effect. The embodiment of FIG. 7B is identical except that the heel 114, 114' is wider and can accommodate a larger top lift and therefore more tire tread and honeycomb material.

The drawings shown herein are not necessarily shown to scale and some features may be exaggerated so that the various layers can be seen by the reader. The top lifts of the present disclosure can have the same dimensions as conventional top lifts used in high heel footwear.

Figure 8:
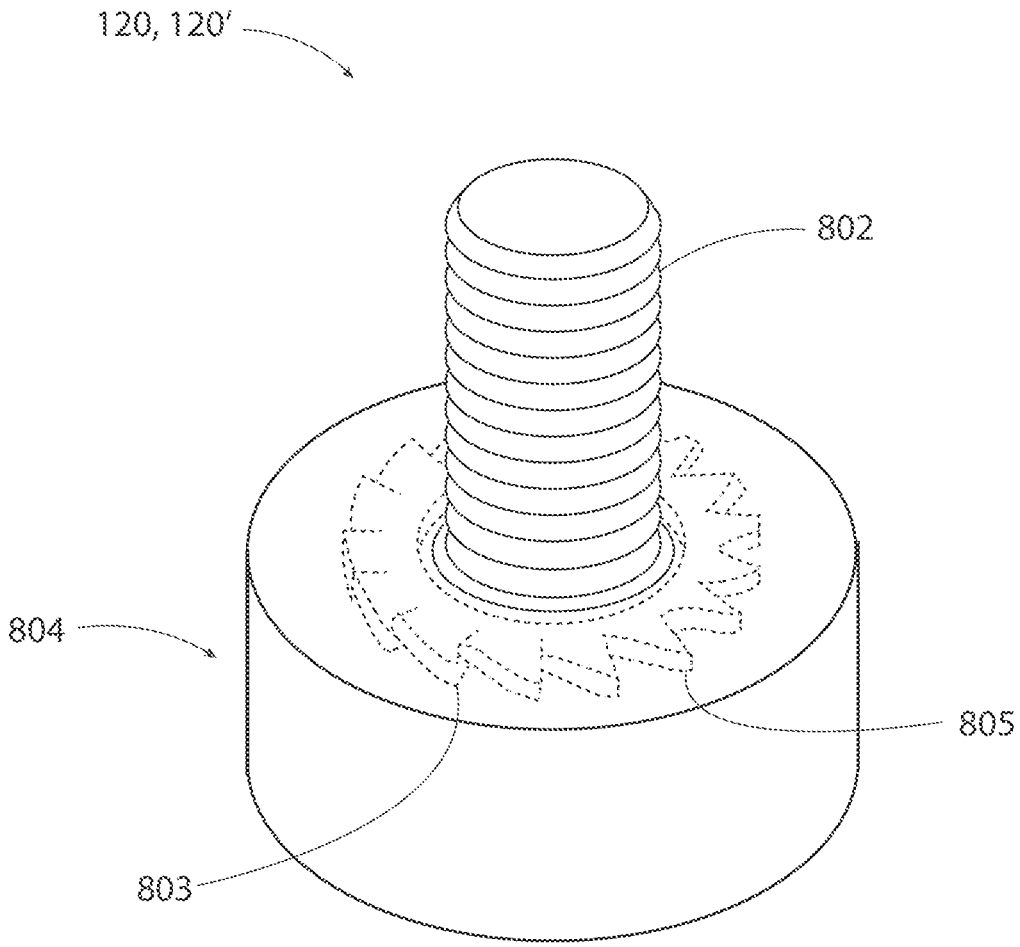
FIG. 8 is an example of another top lift having a base portion made of a solid tire tread material.

FIG. 8 is an example of another top lift 120, 120' that can be used with any heel 114, 114' disclosed herein. Here, a base portion 804 of the top lift shown in FIG. 8 can be made of a solid tire tread material, for example, or of a material that includes rubber. A threaded shaft 802 extends from the base portion 804 and includes a head 803 having teeth 805 around a diameter of the head which prevent the shaft 802 from rotating relative to the base portion 804 when the threaded shaft 802 is screwed into a corresponding threaded hole or bore in the heel 114, 114'. The teeth 805 provide an anti-rotation and a securing feature to prevent rotation of the base portion 804 and to secure it to the heel 114, 114'. The head 803 and teeth 805 are embedded within the base portion 804 so only the threaded shaft 802 can be seen emerging from the base portion 804.

Figure 9A:
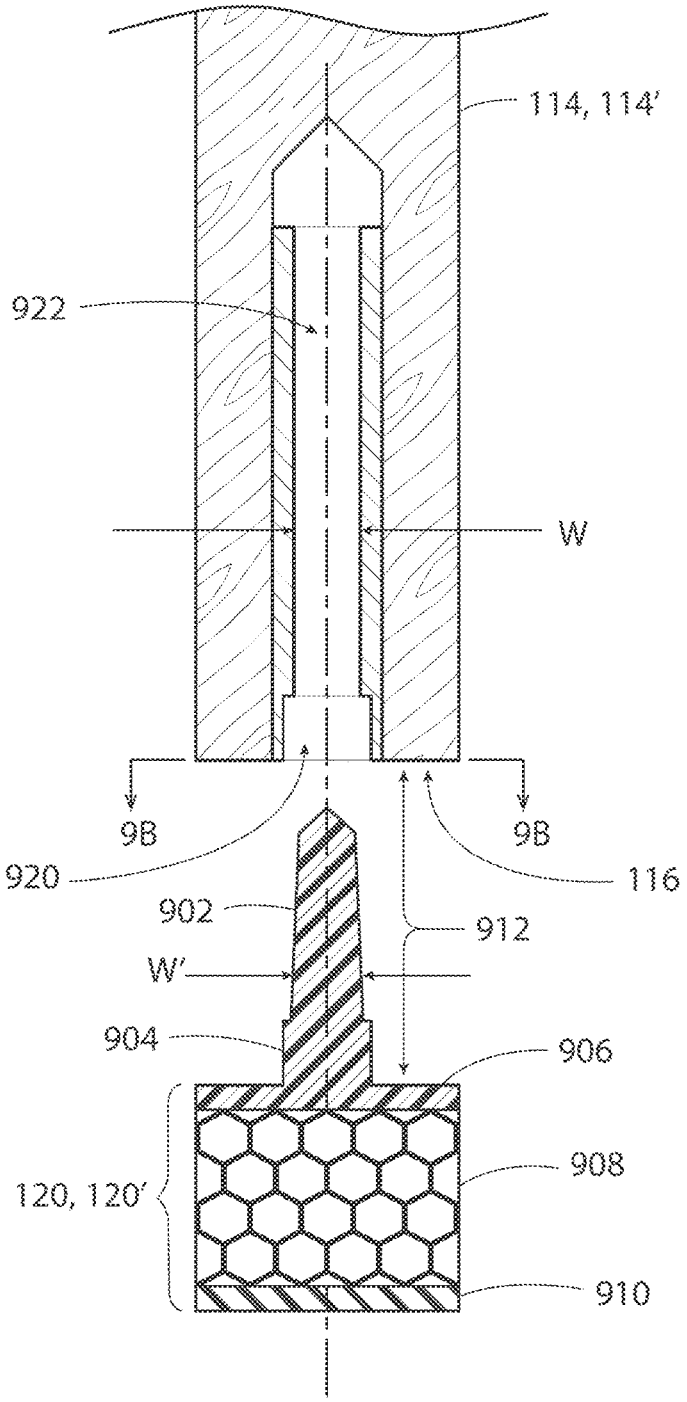
FIGS. 9A and 9B illustrate side and end views, respectively, of a top lift having rotation, securing, and alignment features.
Figure 9B:
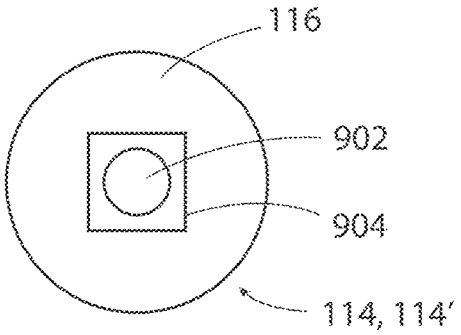

FIGS. 9A and 9B illustrate side and end views, respectively, of a top lift 120, 120' having rotation, securing, and alignment features. A base portion 904 forms an alignment feature, which can have a non-circular cross-section to co-align the base portion 904 relative to the heel 114, 114' so that the outer contours of the base portion 904 and the heel 114, 114' match. The base portion 904 also forms an anti-rotation feature, preventing the top lift 120, 120' from rotating once fully inserted into the heel 114, 114'. The top lift 120, 120' also includes a conical tapered portion 902 that tapers toward a seat or interface 116 of the heel 114, 114' as shown in FIG. 9A. The conical tapered portion 902 is inserted into a bore 922 through a hole 920 that has a corresponding section that receives the base portion 904 (seen in FIG. 9B), and has a width W that is slightly smaller than a width W' of the widest part of the conical tapered portion 902 to form an interference fit inside the bore 922 of the heel 114, 114'. The rest of the top lift 120, 120' can be like any of the top lifts disclosed herein; however, in the example of FIG. 9A, the top lift 120, 120' includes a central portion 908 having a honeycomb pattern made from tire material, including a rubber compound and fillers such as fiber or textiles. The cross-section of the central portion 908 has a honeycomb pattern. The top lift 120, 120' also includes a top portion 910 (i.e., the part that contacts the ground surface) composed of a tire tread material or of solid rubber having a tread-like pattern facing the ground to enhance the grip and friction coefficient relative to the ground surface. The base portion 906 can be composed of, for example, metal, such as the same metal as the conical tapered portion 902 as shown by the cross section in FIG. 9A. To insert the top lift 120, 120' into the bore 922, the top portion 910 can be tapped in, after aligning the non-circular base portion 904 with the hole 920 so that the (irregular) profiles of the heel and top lift match.

Figure 10A:
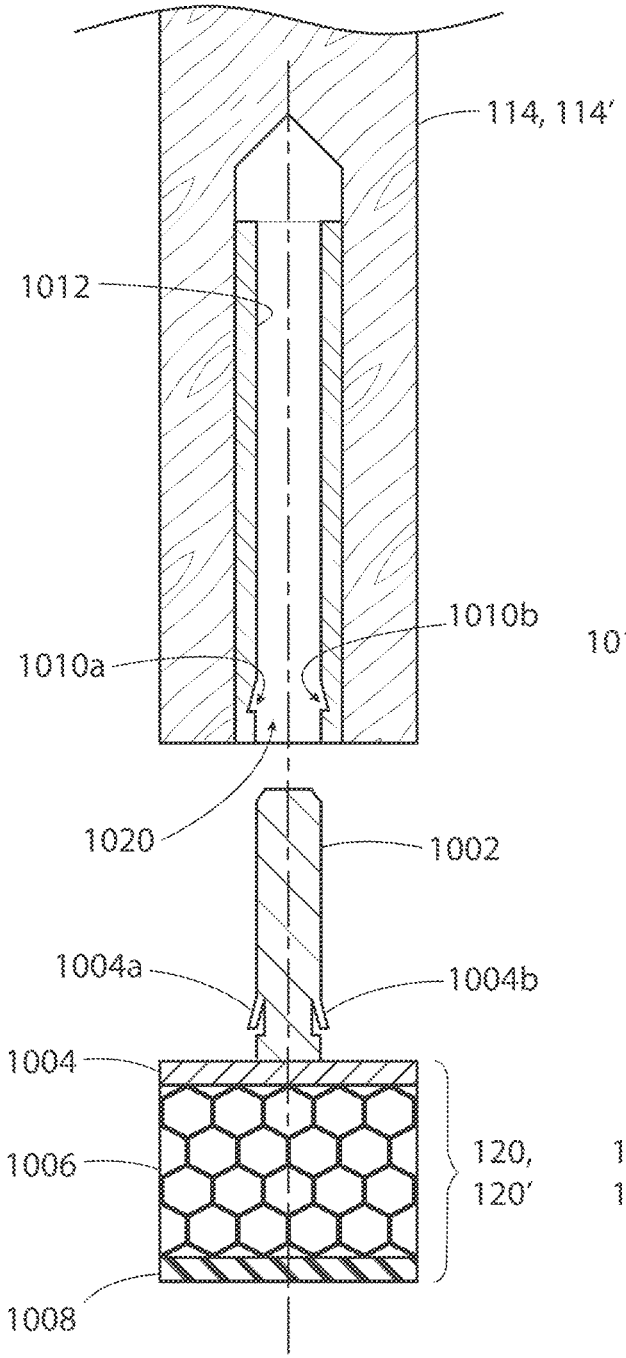
FIGS. 10A and 10B illustrate two additional implementations of a heel tip assembly according to the present disclosure, featuring a different anti-rotation and alignment feature than disclosed in connection with FIGS. 9A and 9B.
Figure 10B:
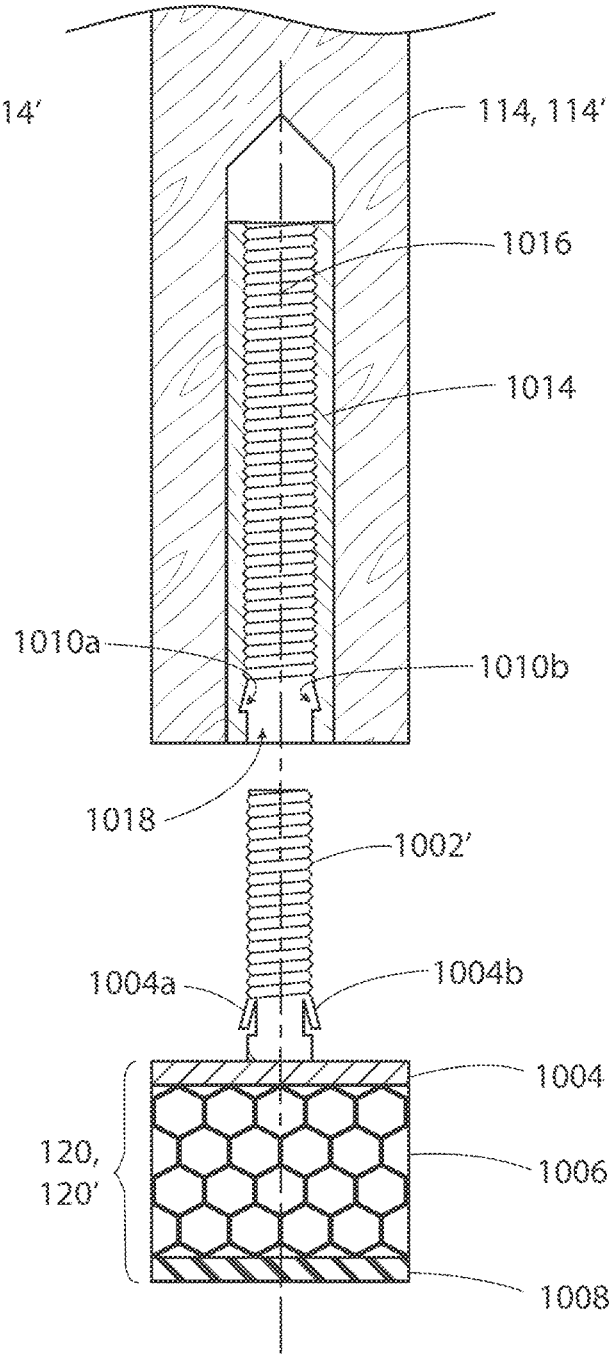

FIGS. 10A and 10B illustrate two additional implementations of a heel tip assembly according to the present disclosure, featuring a different anti-rotation and alignment feature than disclosed in connection with FIGS. 9A and 9B. Here, a shaft member 1002 of the top lift 120, 120' includes a first spring element 1004*a* and a second spring element 1004*b*, which each protrudes away from an elongated surface of the shaft member 1002. The spring elements 1004*a*, 1004*b* form a securing feature part and are biased away from the elongated surface of the shaft member 1002. A base portion 1004 of the top lift 120, 120' is attached to the shaft member 1002, or the base portion 1004 and the shaft member 1002 can be a unitary, integral piece.

The heel 114, 114' includes a hole 1020 and a non-threaded bore 1012 having a first detent 1010*a* and a second detent 1010*b* arranged to receive the spring elements 1004*a*, 1004*b*, respectively, when the shaft member 1002 is inserted into the bore 1012 through the hole 1020. Because the spring elements 1004*a*, 1004*b* are biased outwardly, they will initially be forced inwardly against the shaft member 1002 until they snap outwardly into place within the detents 1010*a*, 1010*b* to form a securing feature but also an anti-rotation and an alignment feature. The rest of the top lift 120, 120' in this example includes a central portion 1006 having a honeycomb pattern composed of a tire tread material, and a top portion 1008, which can be composed of a solid tire tread material or rubber.

In FIG. 10B, the shaft member 1002' is threaded, and the threaded insert 1014 includes a threaded portion 1016 with threads and a non-threaded portion near a hole 1018 through which the threaded shaft member 1002' is inserted. The threaded shaft member 1002' is rotated into the threads of the threaded portion 1016 until the spring elements 1004*a*, 1004*b* click into place within the detents 1010*a*, 1010*b* of the non-threaded portion, to secure the top lift 120, 120' to the heel 114, 114', prevent it from rotating, and co-aligning the two parts so that the respective outer contours match around their entire circumference.

Figure 11:
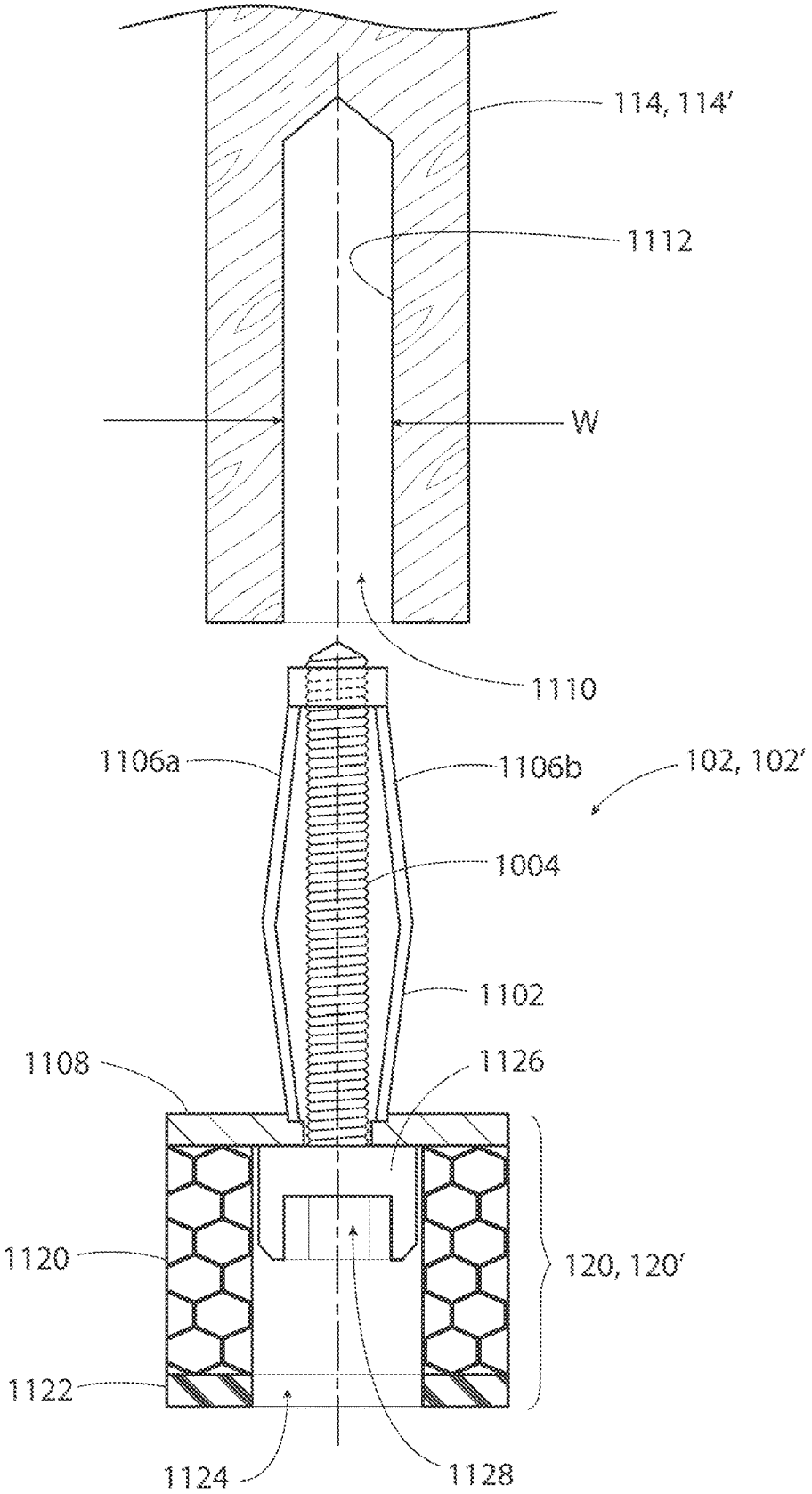
FIG. 11 illustrates a top lift having a screw-actuated anchor to secure the top lift within the heel of the top lift assembly.

FIG. 11 illustrates a top lift having a screw-actuated anchor to secure the top lift within the heel of the top lift assembly. The screw-actuated anchor 1102 includes a first arm 1106*a* and a second arm 1106*b* that flare outwardly from a shaft member 1004 having threads. A base portion 1108 can be made of metal and includes a hole through which the shaft member 1004 extends and terminates at a head 1126 having a tool receiving portion 1128 to receive a tool that rotates the screw-actuated anchor 1102 inserted into the hole 1110. After the screw-actuated anchor 1102 is fully inserted into the hole 1110 of the heel 114, 114', a tool is inserted into the tool receiving portion 1128 of the head 1126 and rotated in situ within the hole 1110, which rotation causes the arms 1106*a,b* to begin to extend outwardly toward the inner surface 1112 of the hole 1110 of the heel 114, 114' until the arms 1106*a,b* press expand the width W of the hole 1110 to provide an anti-rotation feature, which prevents the top lift 120, 120' from rotating or becoming mis-aligned during usage of the high heel footwear. The top lift portion 120, 120' includes a hole 1124 so that a tool can be received in the tool receiving portion 1128. This hole can be plugged after installation with a material to match that of the top lift portion 120, 120', such as a tire tread material. The top portion 1122 can be made of a tire tread material. An insert made from the same tire tread material can be used to plug the hole 1124. The central portion 1120 can have a honeycomb pattern to provide cushioning as discussed above. The arms 1106*a,b* allow minute adjustments of the top lift portion 120, 120' within the heel 114, 114' to co-align the two parts perfectly while the final position is determined by forcing the arms 1106*a,b* apart as much as the material of the heel 114, 114' will allow without damage.

Figure 12A:
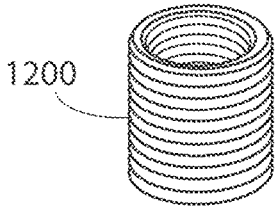
FIGS. 12A and 12B illustrate another way of securing a top lift to a heel of a wider heel, such as shown in FIG. 2.
Figure 12B:
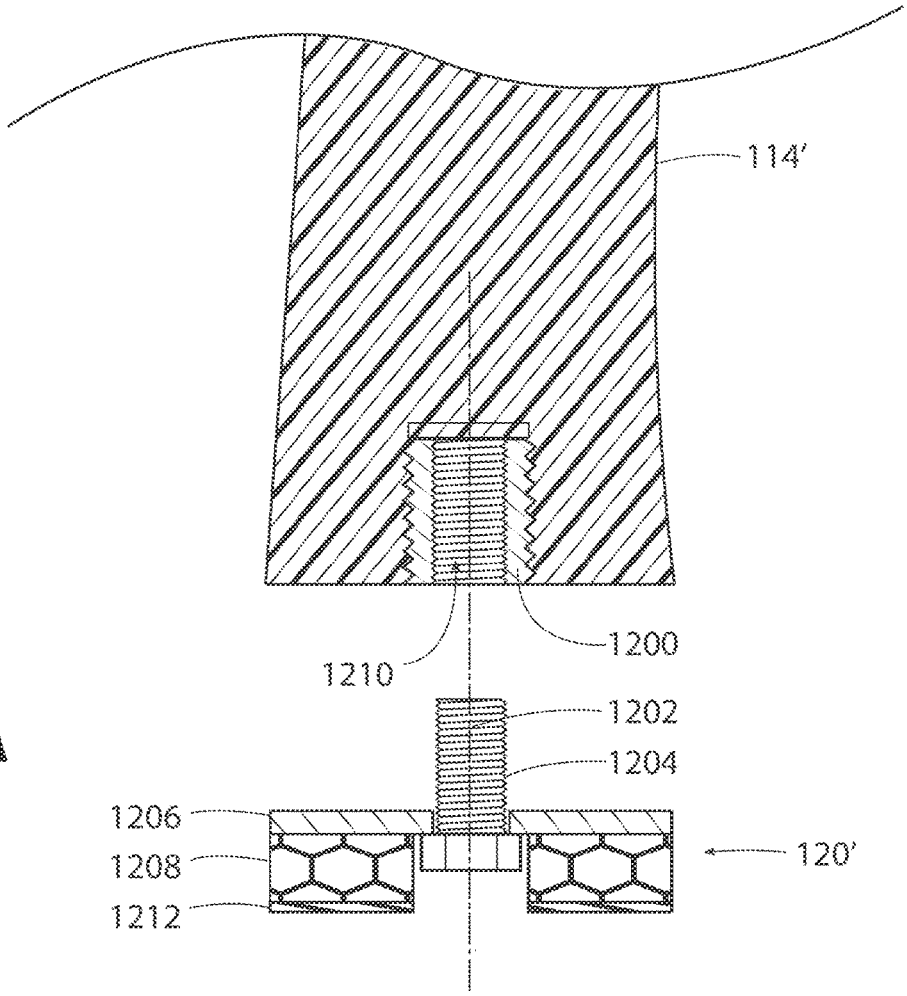

FIGS. 12A and 12B illustrate another way of securing a top lift 120' to a heel 114' of a wider heel, such as shown in FIG. 2. A hollow, self-tapping insert 1200 (shown in FIG. 12A) is screwed into a base of the heel 114', which can be composed of plastic on its interior, making it suitable for receiving a self-tapping insert. The top lift 120' includes a base portion 1206, which can be composed of a metal material, a central portion 1208 having a honeycomb pattern and composed of a tire tread material, and a top portion 1212, which can be composed of a tire tread material having a tread pattern facing the ground. A shaft member 1202 having threads 1204 can be made of metal and is threadably received within the self-tapping insert 1200 installed in the heel 114', thereby providing an anti-rotation and securing feature for the top lift assembly.

Figure 13A:
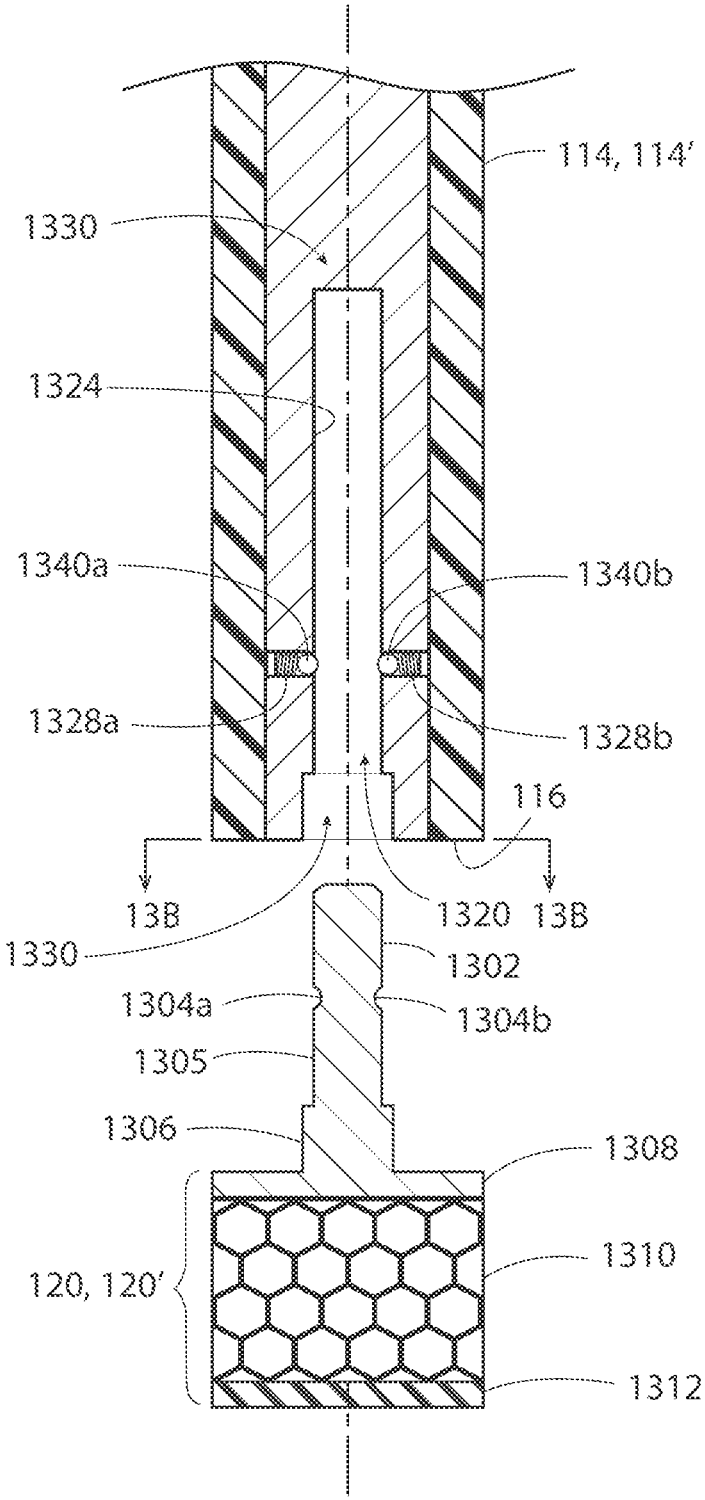
FIGS. 13A and 13B illustrate yet another way of securing any top lift into any heel disclosed herein using springs inside the heel.
Figure 13B:
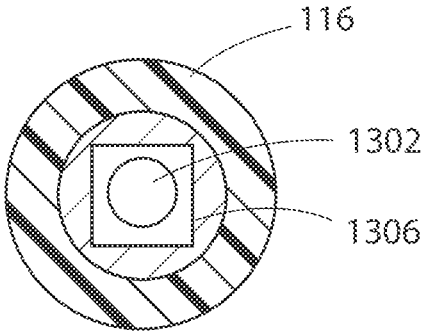

FIGS. 13A and 13B illustrate yet another way of securing any top lift into any heel disclosed herein using springs inside the heel. The top lift 120, 120' includes a shaft member 1302 having a first receptacle 1304*a* and a second receptacle 1304*b* formed along a curved surface 1305 of the shaft member 1302 and a non-circular base portion 1306 that forms an alignment and anti-rotation feature for the top lift 120, 120'. The heel 114, 114' includes an insert assembly 1320 having a hole 1330 that narrows to a narrow portion 1322. The insert assembly 1320 includes a first spring 1328*a* and a second spring 1328*b* and a balls 1340*a*, 1340*b* that protrude from corresponding openings 1326*a,b* extending through a wall 1324 of the insert assembly 1320. The balls 1340*a,b* extend into the opening 1330 of the insert assembly 1320 until the shaft member 1302 is inserted through the opening 1330. When the balls 1340*a,b* align with the receptacles 1304*a,b* of the shaft member 1302, the springs 1328*a,b* allow the balls 1340*a,b* to compress the springs 1328*a,b* like a plunger element as the shaft member 1302 is inserted into the narrow portion 1322 of the insert assembly 1320 until the receptacles 1304*a,b* receive the balls 1340*a,b* and secure the top lift 120, 120' relative to the heel 114, 114'. The non-circular base portion 1306 (e.g., square) fits into the non-circular opening 1330 (e.g., square) to maintain an alignment of the top lift 120, 120', which can have a non-regular outer contour, relative to the heel 114, 114' (shown in FIG. 13B).

FIG. 14 shows two example isometric views of the top lift 120, 120' disclosed in connection with FIGS. 13A and 13B. One of the examples has a regular profile (circular), whereas the other has a non-regular or irregular profile. A round shaft 1402 has detents 1404 to be received in corresponding ball bearings inside the heel 114, 114' as disclosed in connection with FIGS. 13A and 13B. A base 1406 has a square shape and can be made of metal along with the round shaft 1402. The top portion 1408 can include a honeycomb pattern composed of a tire tread material as disclosed above. The square base 1406 permits alignment of the top lift 120, 120' relative to a heel 114, 114' having a non-regular outer contour.

Figure 15:
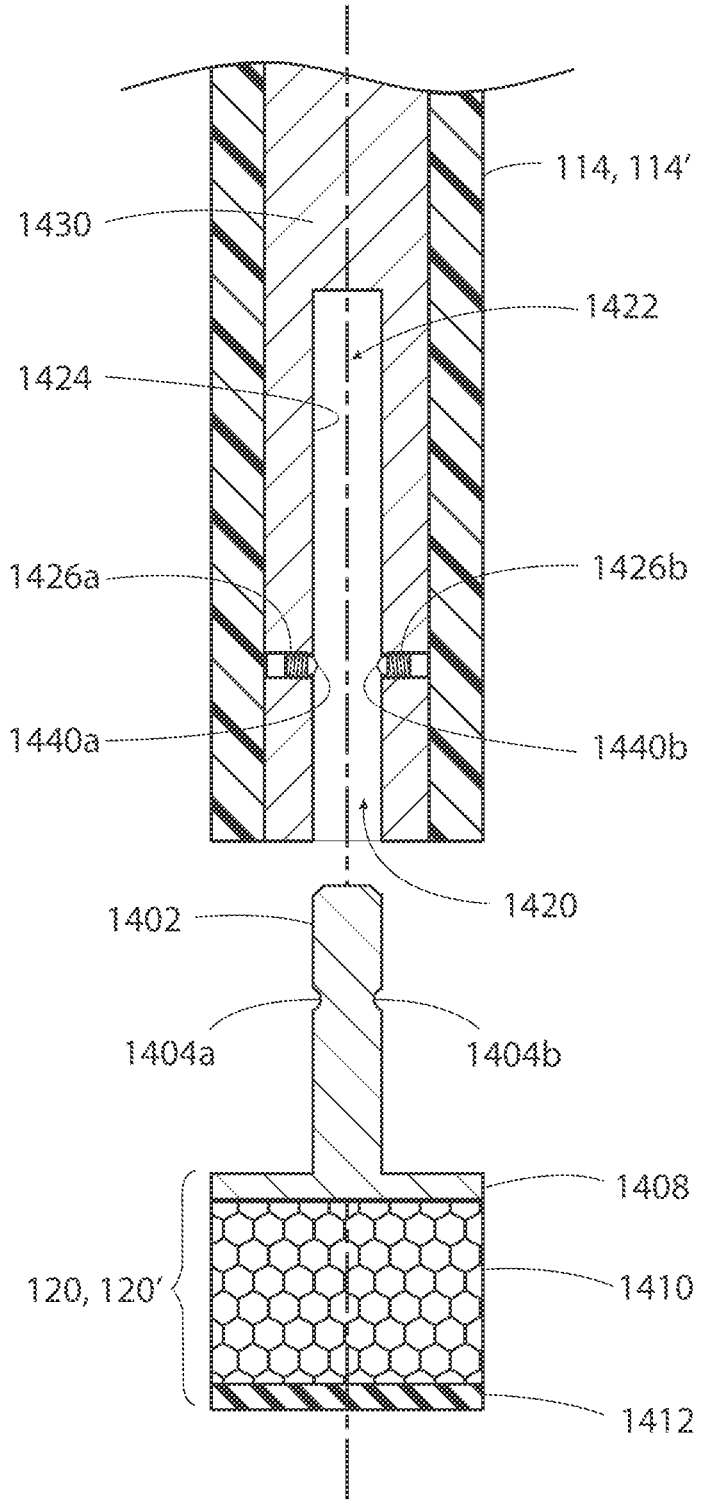
FIG. 15 illustrates another example where a heel includes ball bearings to receive corresponding detents formed in a shaft of a top lift but lacks a square base feature.

FIG. 15 illustrates another example where a heel includes ball bearings to receive corresponding detents formed in a shaft of a top lift but lacks a square base feature. The same reference numbers are used, except that the top lift 120, 120' lacks the base 1406 shown in FIGS. 13A and 13B. This implementation is suitable, for example, for a round heel 114, 114'.

Figure 16:
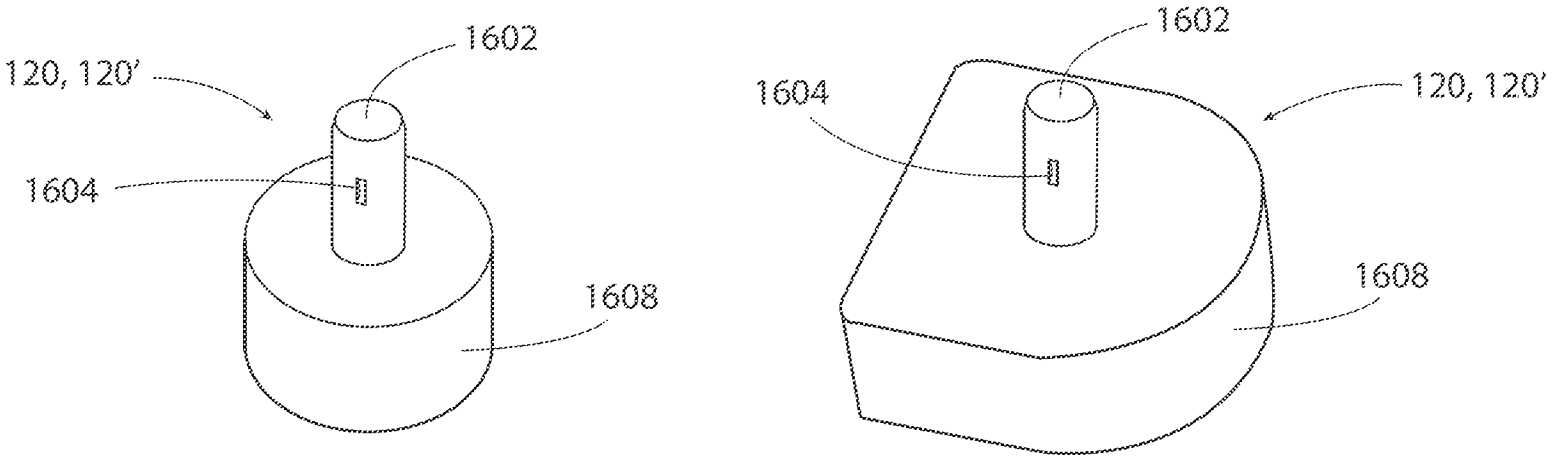
FIG. 16 illustrates two exemplary regularly and non-regularly shaped top lifts having shafts with slots to lock into corresponding features in the heel.

FIG. 16 illustrates two exemplary regularly and non-regularly shaped top lifts 120, 120' having shafts 1602 with slots 1604 to lock into corresponding features in the heel 114, 114' as disclosed above.

Figure 17B:
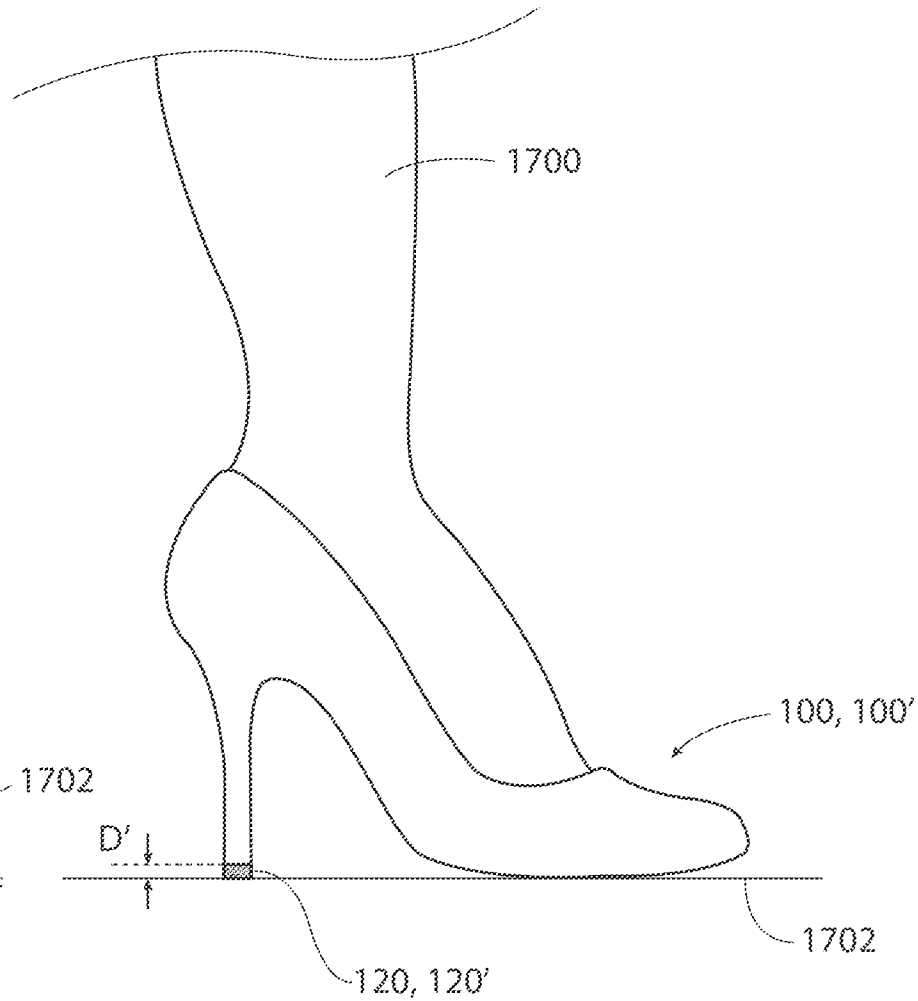
FIGS. 17A and 17B illustrate how the top lift can be slightly longer than the outsole of the high heel footwear when no load is present in the footwear.
Figure 17A:
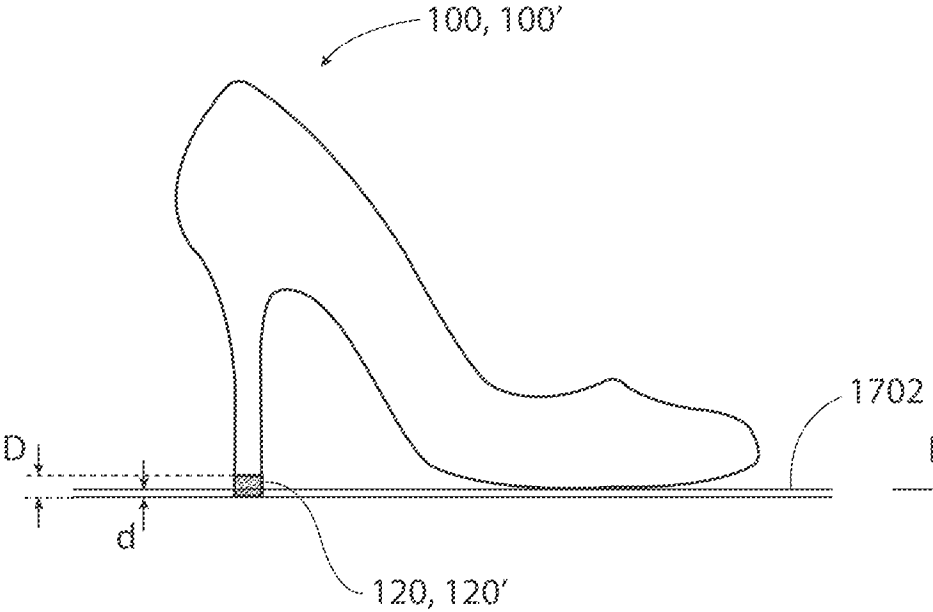

FIGS. 17A and 17B illustrate how the top lift 120, 120' can be slightly longer than the outsole of the high heel footwear 100, 100' when no load is present in the footwear 100, 100'. In FIG. 17A, the top lift 120, 120' extends below the outsole by a distance, d, to provide a total distance from the base to top of the top lift corresponding to a distance D. However, under compression by a load 1700, the top lift 120, 120' as shown in FIG. 17B compresses to reduce the overall distance, D'<D, so that the top lift 120, 120' is aligned on a horizontal plane 1702 with the outsole of the high heel footwear 100, 100'. Because the top lift 120, 120' can compress, such as due to the honeycomb tire tread material, designing the top lift 120, 120' so that it is slightly longer under no compression allows the compression to keep the footwear level under compression.

Figure 18:
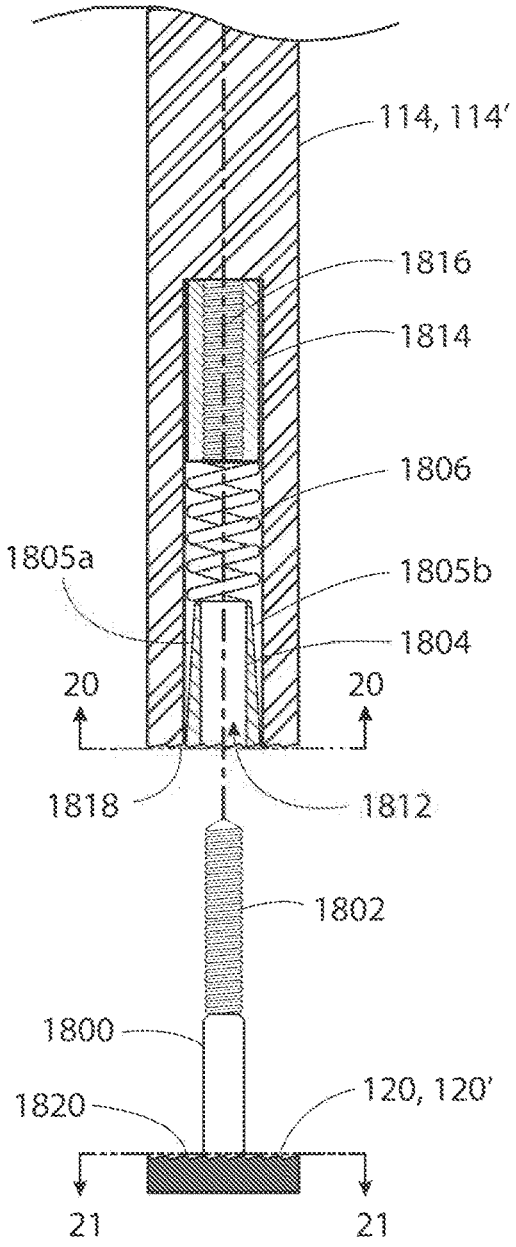
FIG. 18 illustrates a heel tip assembly having a threaded insert that is held in tension inside the heel by a spring.

FIG. 18 illustrates an exploded view of a heel 114, 114' (shown in cross section) and a heel tip assembly 102, 102' having a top lift 120, 120', and a rigid shaft 1800 (e.g., made of metal) having a threaded portion 1802 that screws into a threaded bung or insert 1814 that is inserted into a bore (such as formed by drilling) or opening (such as formed by 3D printing or other additive manufacturing process) 1812 formed in the heel 114, 114'. As shown in FIG. 18, the threaded portion 1802 of the (at least partially) rigid shaft 1800 is inserted into the opening 1812 through a hollow cone-shaped insert 1804, through a central axis of a coil or helical spring 1806, and then rotated so that the threads of the threaded portion 1802 threadably engage corresponding threads 1816 in the threaded insert 1814 to secure the top lift 120, 120' against the heel 114, 114'. As the threaded portion 1802 is rotated to threadably secure it to the threads 1816 of the threaded insert 1814, the spring 1806 begins to compress, thereby pulling the threaded insert 1814 in a lateral direction inside the opening 1812 toward the top lift 120, 120' in a direction D, shown in FIG. 19. The threaded portion 1802 is threaded toward the distal or top end of the rigid shaft 1800, and as shown in FIG. 18, the bottom part of the rigid shaft 1800 does not need to be threaded.

Figure 19:
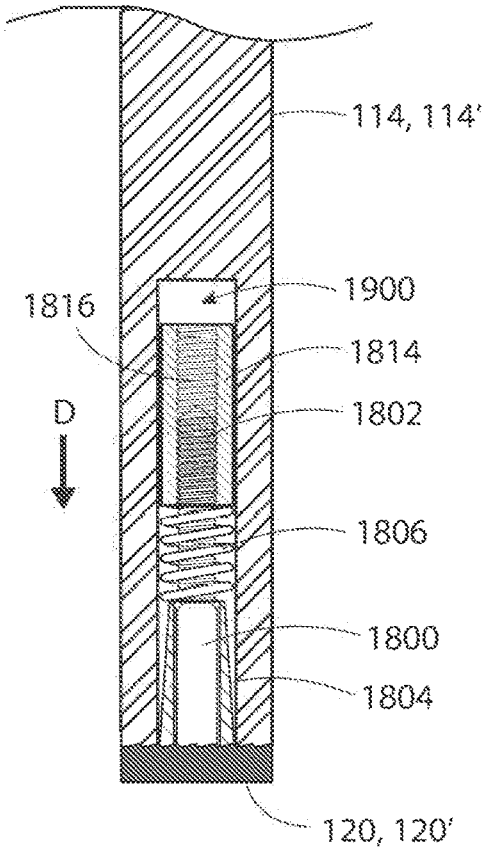
FIG. 19 illustrates the heel tip assembly of FIG. 18 with the threaded insert fully screwed into the heel and held against it by the spring.

As the threaded insert 1814 is pulled in the direction D shown in FIG. 19, a space 1900 is created above the threaded insert 1814. The insert 1804 is fixed or anchored relative to the heel 114, 114' and does not move laterally or rotationally relative to the heel 114, 114'. Any means of fixing the insert 1804 is contemplated. For example, the insert 1804 can have a cone shape with tapered sides 1805*a*, 1805*b* such that the widest end (d2 shown in FIG. 19) of the cone is slightly wider than a diameter of the opening 1812 (d1). The insert 1804 can be tapped into the bore 1812, such as with a hammer, until it is seated and flush with the top of the heel 114, 114'. In this manner, the insert 1804 has a press-fit or interference-fit interface with the inside of the bore 1812. Optional adhesive can be applied along the tapered sides 1805*a,b* of the insert 1804 to further anchor the insert 1804 inside the bore 1812 in the position shown in FIG. 18. The insert 1804 is inserted last into the bore 1812 after the threaded insert 1814 and the spring 1806 have been installed inside the bore 1812.

Because the insert 1804 is anchored inside the bore 1812, as the threaded portion 1802 of the rigid shaft 1800 is screwed into the threaded insert 1814, the coil or helical spring 1806 will compress, causing the threaded insert 1814 to move in a translational, but not rotational, direction D along the bore 1812 toward the top lift 120, 120'. This prevents the threaded insert 1814 from rotating as the threaded portion 1802 is screwed into the threaded insert 1814, the overall width of the threaded insert 1814 can be made slightly larger than a diameter of the bore 1812 (d1) so that the threaded insert 1814 forms an interference or press-fit interface with the inside of the bore 1812. Alternately or additionally, one or more wings or flanges can be provided on the outer circumference of the threaded insert 1814, such that when the threaded insert 1814 is forcibly inserted into the bore 1812, such as by hammering or tapping the threaded insert 1814, the wings or flanges bite into the inner sides of the heel 114, 114', which is typically made of plastic, forging a channel along the side of the bore 1812 along which the threaded insert 1814 can slide up and down in a lateral direction D but cannot rotate about its central axis as the threaded shaft 1802 is screwed into the threaded insert 1814.

Figure 20:
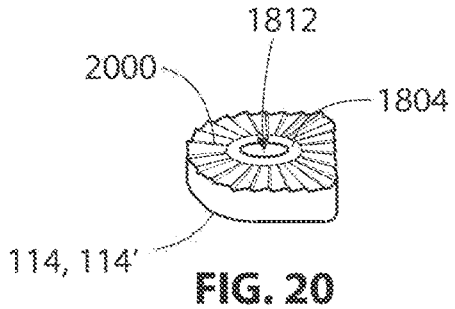
FIG. 20 is a top view of the heel taken along line 20-20 shown in FIG. 18.
Figure 21:
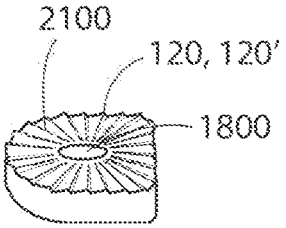
FIG. 21 is a bottom view of the top lift taken along line 21-21 shown in FIG. 18.
Figure 22A:
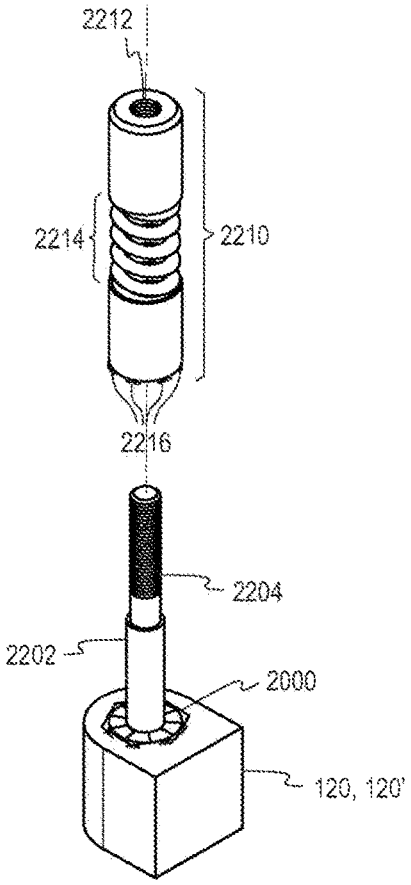
FIGS. 22A-22D show an exemplary heel tip assembly having a top lift with a rigid shaft and insert according to another aspect of the present disclosure.
Figure 22B:
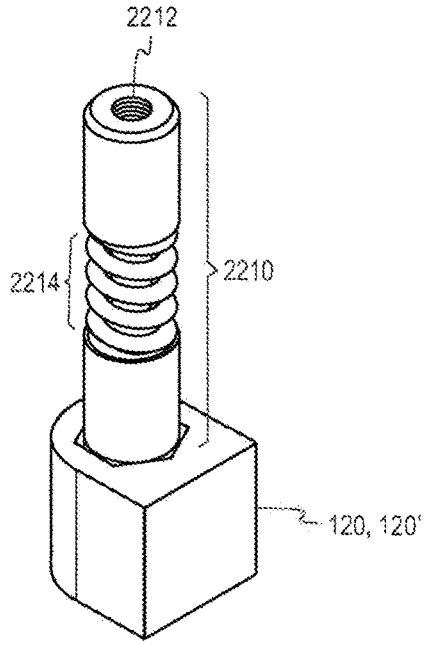
Figure 22C:
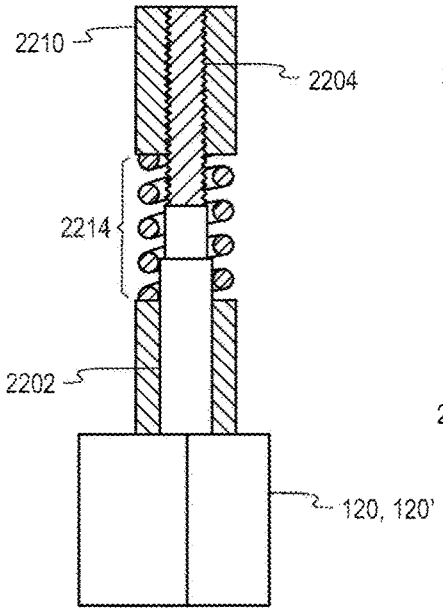
Figure 22D:
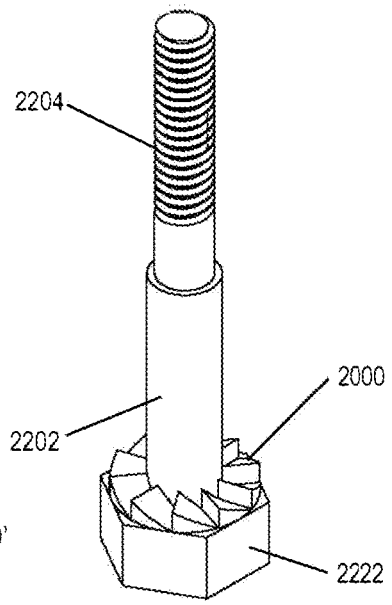

The threaded shaft 1802 together with the threaded insert 1814 form a securing feature to align the top lift 120, 120' relative to the top of the heel 114, 114' once installed therein. Alignment and anti-rotation features are shown in FIGS. 20 and 21, which show respective wedge-lock features or patterns 2000, 2100, which can be made of metal. The wedge-lock feature or pattern 2000 can be machined on the top 1818 of the heel 114, 114', or attached to the exposed end of the top 1818 of the heel 114, 114' as, for example, a metal (or hard plastic or other rigid material) washer having the wedge-lock pattern 2000. The wedge-lock pattern 2000 corresponds to the wedge-lock feature or pattern 2100 formed on the heel-interfacing surface 1820 of the top lift 120, 120'. The wedge-lock pattern 2100 can also be attached to the top lift 120, 120' as, for example, a metal washer having the wedge-lock pattern 2100. Because the top part of the top lift 120, 120' (the part that contacts the ground) is made of, for example, a material including rubber, having the wedge-lock pattern 2100 made from a more robust material, such as a material including metal or a hard plastic or other rigid material, allows a more secure and reliable interface to be established with the heel 114, 114'. When the wedge-lock pattern 2100 is formed as, for example, a metal or plastic washer, the metal washer is securely attached, such as by adhesive, to the rubber part of the top lift 120, 120'. As the heel-interfacing surface 1820 of the top lift 114, 114' mates with the corresponding wedge-lock pattern 2000 on the top 1818 of the heel 114, 114' as the top lift 120, 120' is being rotated to secure the threaded shaft 1802 inside the threaded insert 1814, the corresponding wedge patterns lock the two pieces 120, 120' and 114, 114' in a wedge-lock fashion together. The spring 1806 allows the wedge patterns 2000, 2100 to override one another briefly until they snap into a wedge-lock configuration as the threaded shaft 1802 is turned against the heel 114, 114'. The user or installer will receive tactile feedback as the wedge locks snap or click into place as the shaft 1802 is being tightened against the heel 114, 114'. Again, the spring 1806 provides some "give" to the shaft and top lift assembly to allow the wedges to override and lock into place. The number, shape, and position of the wedge locks in the patterns 2000, 2100 can be a function of the width of the heel 114, 114' and the outer contour shape of the heel 114, 114'.

In the final, secured position, the wedges of the wedge lock patterns 2000, 2100 are locked into place against one another, and held in tension against the top 1818 of the heel 114, 114' by the tension of the spring 1806 pushing against the fixed insert 1804, causing the shaft 1802 to be biased in a direction away from the top 1818 of the heel 114, 114' (e.g., in a direction opposite of direction D shown in FIG. 19).

A method of retrofitting an existing heel is also disclosed. A cobbler or user drills the opening 1812 into the heel 114, 114' if the opening is not already present there. The user inserts the threaded insert 1814, which can optionally have one or more outer flanges or wings, into the opening 1812, and then taps or hammers the threaded insert 1814 into the opening 1812, such as with the aid of a shank or punch to seat the threaded insert 1814 all the way into the opening 1812 in the installed position shown in FIG. 18. Then, the user inserts the spring 1806 against the insert 1814 through the opening 1812. To complete the heel assembly, the user inserts the insert 1804 through the opening 1812 and taps it into the opening against the spring 1806 until the insert 1804 is flush against the top 1818 of the heel 114, 114'. Optional adhesive can be applied to the insert 1804 prior to insertion to further anchor and secure it inside the bore 1812.

Now that the heel 114, 114' has been primed to receive the threaded shaft 1802, the user inserts the threaded shaft 1802 through the opening of the insert 1804, which then passes through the opening of the coil spring 1806, and finally can be screwed into the threads 1816 of the threaded insert 1814 at the distal end of the bore 1812. The user continues to rotate the threaded shaft 1802, such as by grasping the top lift 120, 120', to tighten the threaded shaft 1802 against the heel 114, 114'. Tactile and audible clicks can be felt and heard as the wedge locks 2000, 2100 secure the top lift 120, 120' against the top 1818 of the heel 114, 114'. When the outer profile or contour of the top lift 120, 120' and the heel 114, 114' has an irregular geometric shape, such as shown in FIGS. 20 and 21, the user continues to rotate the threaded shaft 1802 until the respective contours of the top lift 120, 120' and of the heel 114, 114' align.

To remove the top lift 120, 120', such as to replace a worn rubber tip or replace the entire top lift 120, 120' with a new one, the user counter-rotates the top lift 120, 120' in a direction to loosen the same from the threaded insert 1814 until the threads of the threaded shaft 1802 are free from the corresponding threads 1816 of the threaded insert 1814 and the threaded shaft 1802 can be removed from the opening 1812 and a new or replacement one can be installed. This embodiment is truly a do-it-yourself implementation, in which the wearer of the shoe can carry out the installation and/or replacement of top lifts 120, 120' by themselves without the need to seek out a cobbler or other professional. The entire assembly can be bundled together as a kit, together with a shank or punch that can be used to fully insert the threaded insert 1814 into the opening 1812. Importantly, replacement of an old top lift and installation of a new top lift can be carried out simply by manually (e.g., by human hand) unscrewing the old top lift and manually screwing in a new top lift without requiring any tools whatsoever.

FIGS. 22A-22D show an exemplary heel tip assembly 102, 102' having a top lift 120, 120' comprising a rigid shaft 2202 and insert 2210. Insert 2210 can be made of metal, plastic, or any 3D-printing material. Insert 2210 can be sized and shaped to fit within an opening in a heel (for example, the opening as discussed with respect to FIGS. 18-19). Insert 2210 can comprise an elastic element 2214 and a hollow interior (shown in FIG. 22C) with a threaded interior 2212. As a brief overview of the heel tip assembly of FIGS. 22A-22C, the assembly provides for a user inserting the insert 2210 into a heel 114, 114' (heel 114, 114' is not pictured). The user can then put the rigid shaft 2202 through the hollow interior of the insert 2210 until the threaded end portion 2204 of the rigid shaft 2202 engages with the threaded interior 2212 of the insert 2210. The user can screw the rigid shaft 2202 into the insert 2210 until the rigid shaft 2202 cannot be rotated further. During the screwing motion, the elastic portion 2214 will be pulled downwardly (toward the top lift 120, 120') onto the rigid shaft 2202. This will cause the restorative force of the rigid shaft to exert an upward pressure on the rigid shaft 2202. The various components of the assembly are discussed in greater detail below.

The elastic element 2214 can be shaped as a spring or another cutaway design. The elastic element 2214 provides a restorative force to return to an original, uncompressed configuration when the elastic element 2214 is compressed by, e.g., a user or pressure from the rigid shaft 2202. In some examples, elastic element 2214 can be a coil or helical spring designed for compression and tension. Such a spring can be designed to operate with a compression load, so that the spring compresses and becomes shorter as a load is applied to it. Therefore, as insert 2210 receives rigid shaft 2202, the screwing motion of 2202 will pull down, or compress insert 2210, and more specifically, compress at the elastic element 2214. Therefore, elastic element 2214 will exert an upward pressure to uncompress. This upward pressure will pull rigid shaft 2202 further into the heel 114, 114'.

In other examples, elastic element 2214 can be a torsion spring, configured to receive a load by a torque or twisting force. Therefore, when rigid shaft 2202 is screwed into the threaded interior 2212, one end of the elastic element 2214 can be configured to rotate or twist through an angle, for example, rotate clockwise. This rotating motion of the elastic element 2214 can cause elastic energy to be stored in the elastic element 2214. The elastic element 2214 can then cause the elastic insert 2210 (and the now-attached rigid shaft 2202) to press upward into the heel 114, 114' as it is pulled by the torsion's spring pressure to rotate counter-clockwise and return to an original spring state. In some examples, elastic element 2214 can therefore be a torsion spring consisting of torsion fiber, an elastic metal or rubber configured to absorb spring energy.

A person skilled in the art understands that elastic element 2214 can be many other types of springs, such as a variable spring, a serpentine spring, a volute spring, a Belleville spring, and/or a main spring. In some instances, elastic element 2214 can be an elastic material such as any elastomer, natural rubber, synthetic rubber, nitrile rubber, silicone rubber, urethane rubbers, chloroprene rubber, an elastic metal, and any combination thereof. Elastic element 2214 can additionally have many shapes, including a helix shape, a spiral, a grid shape, a conical shape, zig-zag shape, non-coiled, and/or flat. Additionally, elastic element 2214 can be solid element, with no cut-away design, relying solely on the elasticity of the elastic element's 2214 material.

Figure 28A:
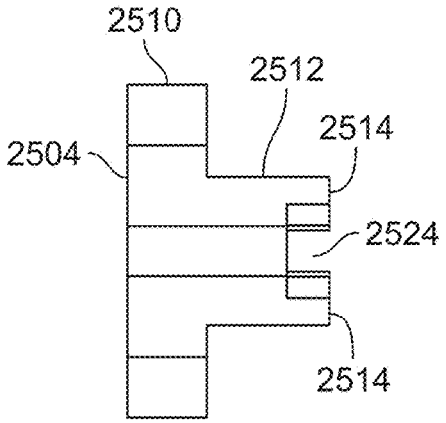
FIG. 28A is a side section view of the top lift insert in the heel system of FIG. 25.

Rigid shaft 2202 can include a threaded end portion 2204. The threaded end portion 2204 can be sized and shaped to fit within the hollow interior of insert 2210 and to engage with the threaded interior 2212 during the screwing motion. In some examples, the rigid shaft 2202 can have a wedge-lock feature or pattern 2000 configured to match a heel-interfacing surface 2216 of the top lift 120, 120' (as discussed earlier with regards to FIGS. 28-21). Therefore, these patterns 2000 and 2216 can be corresponding shapes such that when the insert 2210 receives the rigid shaft 2202, the patterns 2000 and 2216 can engage each other. In some instances, when the threaded end portion 2204 is screwed into the insert 2210, there can be one or more clicks when the patterns 2000 and 2216 engage each other. This provides a user with tactile and audible feedback to ensure that the insert has properly received the rigid shaft 2202. Additionally, the patterns 2000 and 2216 can ensure perfect alignment between the rigid shaft 2202 and the insert 2210 such that the assembly as a whole aligns with a heel 114, 114'.

Therefore, a heel tip assembly 102, 102', as shown by FIGS. 22A-22D provides a dual element assembly 102, 102' which can be inserted by a user into a heel 114, 114' with ease. This assembly has a small number of components which makes it a quick and easy product to provide additional structural support to a heel 114, 114'. When inserted into a heel 114, 114' as described with respect to FIGS.

22A-22D, the assembly can provide a unitary (one piece) element configured to provide structure, stability, and support to heel 114, 114'. The assembly therefore cannot be disassembled into its individual pieces without a user exerting a force to unscrew the rigid shaft 2202; the force exerted by the user needs to be stronger than the force exerted by the elastic portion 2214 that is pulling the rigid shaft 2202 back into the heel 114, 114'.

Figure 23A:
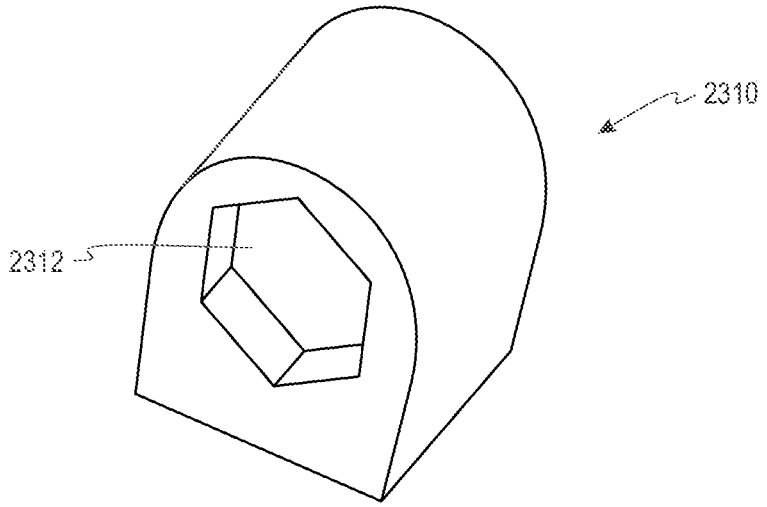
FIGS. 23A, 23B, and 23C show another exemplary heel tip assembly according to another embodiment of the present disclosure.
Figure 23B:
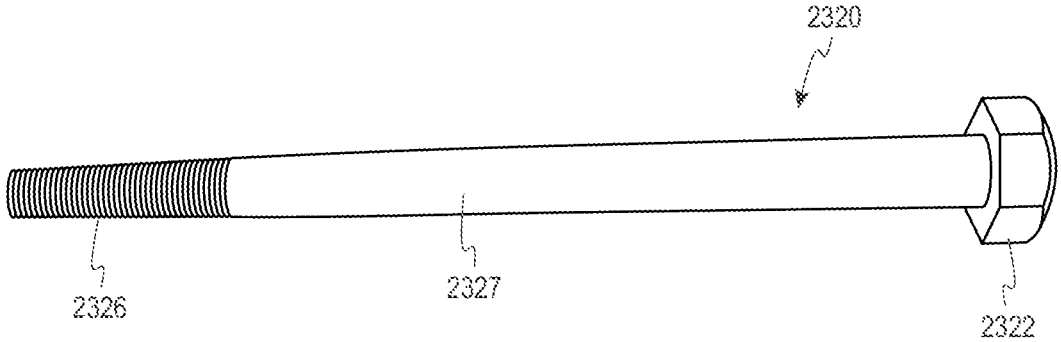
Figure 23C:
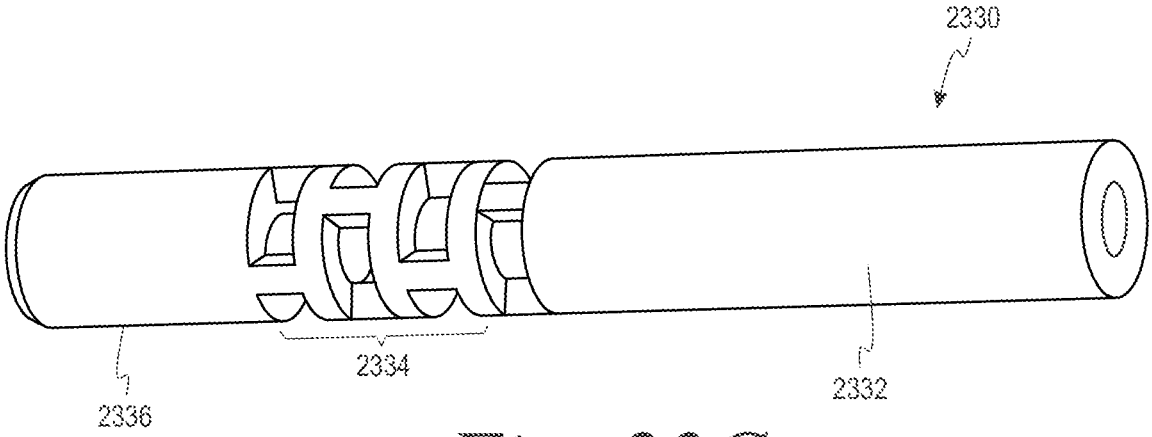
Figure 24:
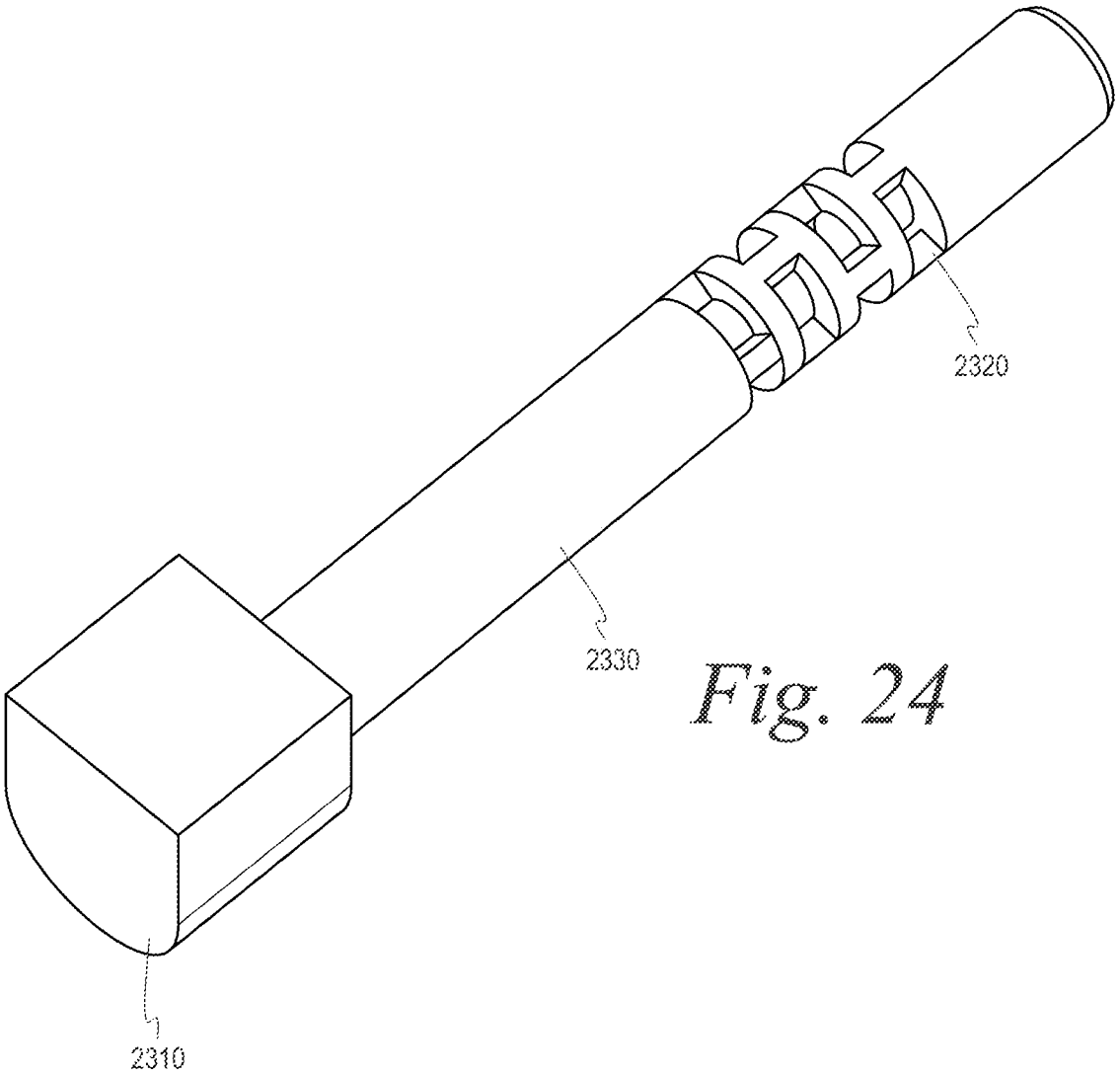
FIG. 24 shows still another exemplary heel tip assembly according to another embodiment of the present disclosure.
Figure 25:
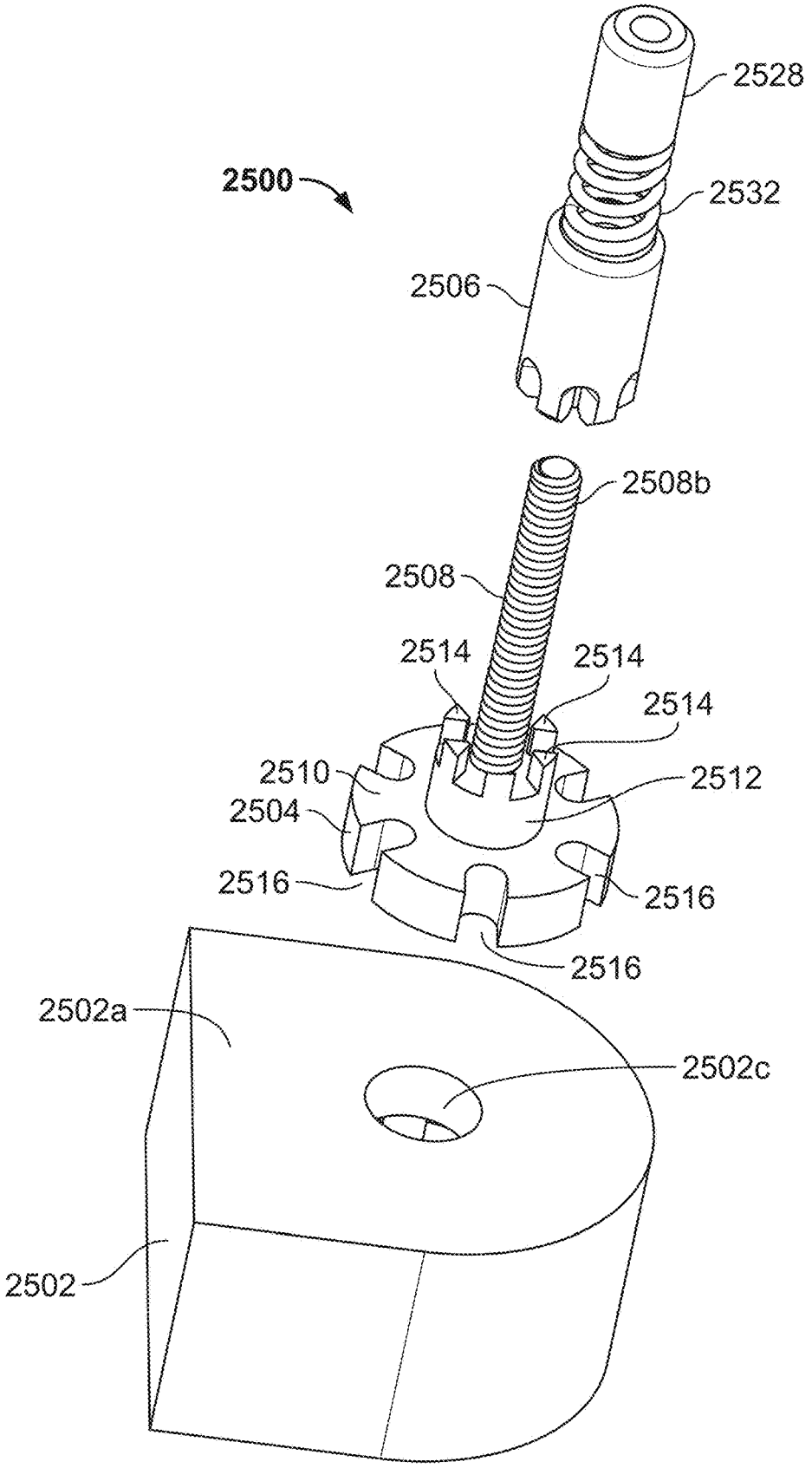
FIG. 25 is an exploded view of a heel system and top lift according to an exemplary embodiment of the present disclosure.

FIGS. 23A, 23B, 23C, and 24 show another exemplary heel tip assembly 102, 102', according to another embodiment of the present disclosure. The assembly, as shown in FIG. 24, can include a heel tip 2310 (FIG. 23A), a shaft piece 2320 (FIG. 23B), and an elastic insert 2330 (FIG. 23C). All three components 2310, 2320, and 2330 can be 3D-printed, constructed in a plastic mold, or any other similar process, without limitation. Components 2310, 2320, and 2330 can be made of tire tread material, rubber, plastic, and metal, any combination thereof, and any similar material. Components 2310, 2320, and 2330 can be made of the same or different materials. Generally, the elastic insert 2330 can be placed inside an opening in a heel which is a similar size to the elastic insert 2330. The shaft piece 2320 can be screwed into the elastic insert 2330. The heel tip 2310 can be placed onto the shaft piece 2320. Therefore, the heel tip assembly as shown in FIGS. 23A-23C and 24 can form a structural insert and sole for a high-heeled shoe. Additional features are discussed further below.

FIG. 23A shows an exemplary heel tip 2310 which can include a cutout portion 2312. The heel tip 2310 can be shaped to match a contour of the heel which heel tip 2310 is ultimately secured. The cutout portion 2312 can be sized and shaped to receive the shaft piece 2320. The cutout portion 2312 can be a hexagonal shape, for example, although any other circular or polygonal shape is contemplated as well. The heel tip 2310 can be rotated when connecting to the shaft piece 2320 such that the heel tip 2310 aligns with the contour of the heel.

FIG. 23B shows an exemplary shaft piece 2320 which can include a shaft head 2322, a shaft body 2324, and a threaded portion 2326. The shaft head 2322 can be configured to match the shape and size of the cutout portion 2312 such that shaft head 2322 forms an interference fit with cutout portion 2312. The heel tip 2310 can be put onto the shaft head 2322 by a user or installer. The threaded portion 2326 can be configured to match a threaded sleeve 2336 of the elastic insert 2330.

FIG. 23C shows the elastic insert 2330, which can include a shaft portion 2332, an elastic portion 2334, and a threaded sleeve 2336. The elastic insert 2330 can have a hollow interior with which to receive the shaft piece 2320. The shaft portion 2332 can protect the shaft piece 2320, as it is received by the elastic insert 2330, from rubbing against a heel in which the elastic insert 2330 is inserted. The threaded sleeve 2336 can receive the threaded portion 2326 of the shaft piece 2320. While the shaft piece 2320 is screwing into the threaded sleeve 2336, the elastic portion 2334 can be compressed and rotated. The elastic portion 2334 can provide a resultant force pulling the shaft piece 2320 deeper into the hollow interior of the elastic insert 2330. The interference fit between the elastic insert 2330 and the heel can prevent the elastic insert 2330 from rotating to relieve the elastic force caused by the shaft piece 2320. In some examples, an adhesive element can be placed on the exterior of the elastic insert 2330 before it is inserted into a heel to further prevent the elastic insert 2330 from rotating.

Elastic portion 2334 can be a variety of shapes and sizes although only one shape and size is demonstrated in FIGS. 23C-24. The elastic portion 2334 can shaped as a spiral, a spring, a grid shape, an off-center grid, or a lattice or lattice-like structure. The elastic portion 2334 can have cutaway portions in the shape of rectangles (as shown in FIG. 23C), ovals, helices, spirals, honeycomb, or any other cutaway form. Elastic portion 2334 can have a regular and symmetrical shape (as shown in FIG. 23C), or an irregular, a symmetrical shape (e.g., a spiral where top portions of the spiral are more spaced out than lower portions). In some cases, elastic portion 2334 can be solitary curved lines rising from the shaft portion 2332 to the curved portion 2336. Design shapes can be chosen according to weight, material, and elasticity concerns. Elastic portion 2334 can further include all the non-limiting exemplary embodiments as discussed with respect to elastic element 2214 of FIGS. 22A-22C. The elastic portion 2334 preferably has a regular, repeating pattern or shape so that the elastic portion 2334 compresses or expands uniformly about a cross section thereof without breaking or crushing any vertical members or elements of the pattern or shape that provides or imparts the elasticity or springiness to the elastic portion 2334. The design or pattern of the elastic portion 2334 can be selected based on suitability for being made according to 3D printing methods. The entire insert 2330 together with the elastic portion 2334 shown in FIG. 23C can be a unitary, one-piece integral structure, for example, constructed according to a 3D printing method. The elastic portion 2334 can have a lattice-like pattern having compressible members that can be restored to a pre-compressed state without being crushed or broken.

FIG. 24 demonstrates how the three pieces, as shown individually in FIGS. 23A-23C can cooperate to provide structure, stability, and support to a heel 114, 114' when the elements are assembled. The assembly cannot be disassembled into its individual pieces without a user removing the heel tip 2310 and exerting a force to unscrew the shaft piece 2320 from the elastic insert 2330; the force exerted by the user needs to be stronger than the force exerted by the elastic portion 2334 that is pulling the shaft piece 2320 back into the heel 114, 114'.

Any of the top lifts disclosed herein can be used in connection with any of the heels, and any anti-rotation feature can be combined with any alignment feature and/or any securing feature and/or any cushioning feature disclosed herein. It is seen that the combination of these features contributes to the overall stability, wearer comfort, noise suppression, longevity, customizability or interchangeability, facile and expedient construction and manufacturability, and repairability or serviceability, to name a few benefits, of the high heel footwear, particularly over prolonged usage. The honeycomb pattern provides a cushioning effect, a tire tread top (facing the ground) provides a grip or anti-slipping feature while also suppressing the sound the heel makes when contacting a ground surface, such as a polished floor or tile, the various securing features provide a secure way of interfacing the top to the heel, sometimes in a way that is reversible, and the alignment features ensure that the outer contour of the top lift and heel at their interface match so that no visual artifacts are perceived. The alignment should be made blindly so that the manufacturer or installer can quickly secure the top lift to the heel without having to make minor adjustments to ensure co-alignment. The alignment feature also stands up to prolonged wear and tear over time, ensuring that the top lift and heel remain aligned. The anti-rotation features disclosed herein prevent rotation of the top lift relative to heel, which prevent twisting moments and misalignment of the top lift relative to the heel over prolonged use. The various materials used, such as tire tread material, rubber, plastic, and metal, can be interfaced together securely or permanently by adhesive or any other technique for interfacing such materials to metal. The embodiments of FIGS. 18-24 provide a do-it-yourself assembly that allows the wearer of the footwear to retrofit an existing footwear with a replaceable heel tip that can be secured to the heel and then removed easily and replaced with a new one. Alternately, the heel of the footwear can be adapted by the manufacturer to include the internal components described above in connection with FIGS. 18-19 and 23B-23C, and then the wearer can readily replace him- or herself the heel tip with a new one by simply unscrewing and removing the old one and installing a new one merely by screwing the new one in with absolutely no tools required.

Referring to FIGS. 25-32, a heel system 2500 for coupling a top lift 2502 and heel 2503 of a footwear is shown. Heel system 2500 comprises a top lift insert 2504, a heel insert 2506, and a shaft 2508.

Figure 26:
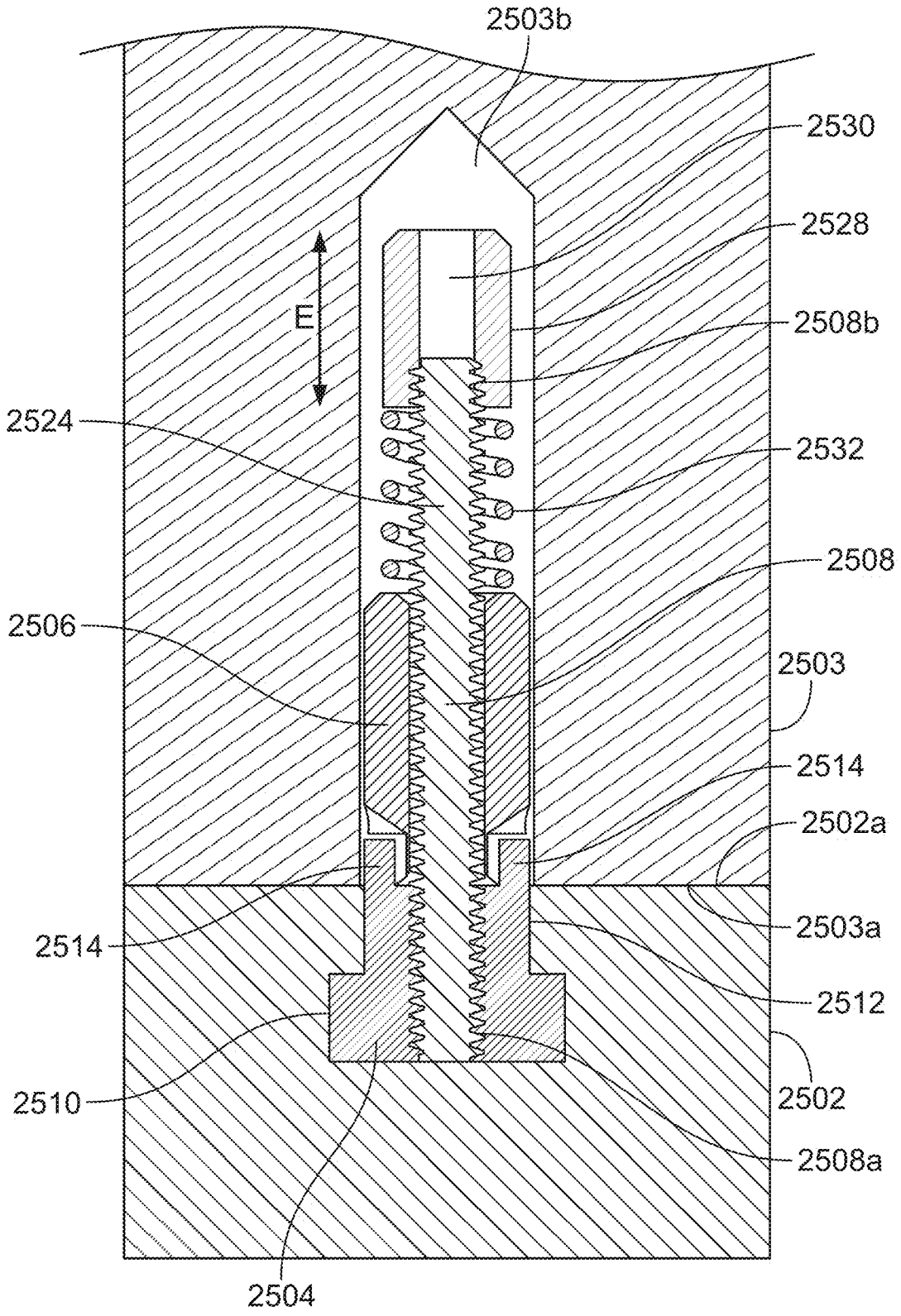
FIG. 26 is a side section view of the heel system of FIG. 25, coupling a top lift and heel.
Figure 27:
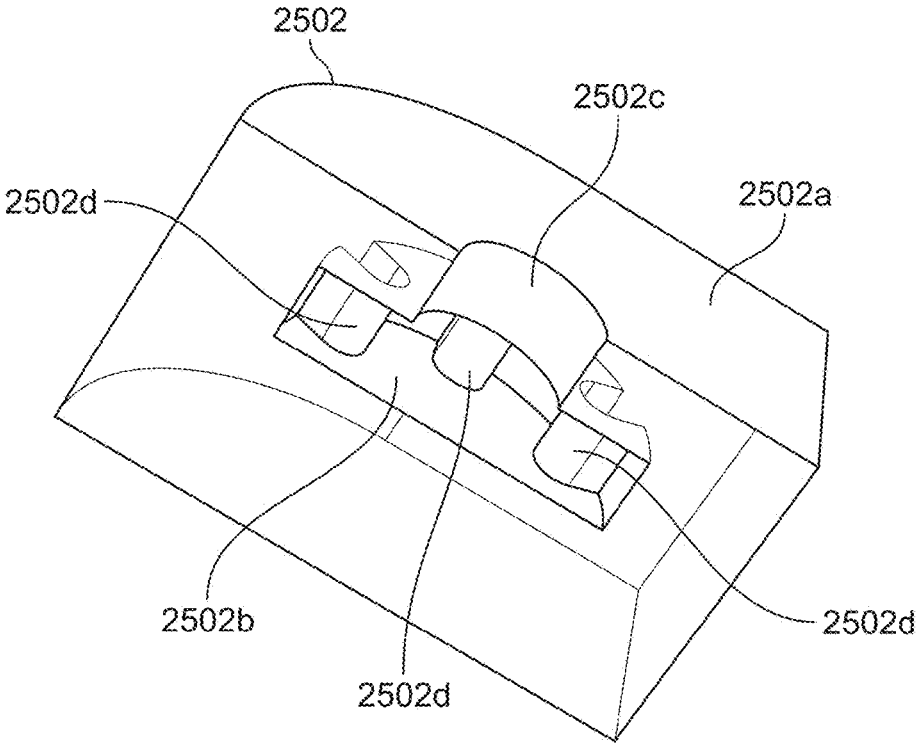
FIG. 27 is an orthographic section view of the top lift of FIG. 25.

In one embodiment, top lift insert 2504 has a base 2510, and a shaft 2512 projecting from the base. A plurality of spaced teeth 2514 project from the end of shaft 2512 opposite base 2510. In a preferred embodiment, teeth 2514 are arranged in a circular configuration similar to a crown gear. Top lift insert 2504 is coupled to top lift 2502. In one embodiment, top lift 2502 has an outer surface 2502*a*, an internal cavity 2502*b* with an opening 2502*c* to the outer surface. Cavity 2502*b* is sized and shaped to receive base 2510, and opening 2502*c* is sized and shaped to receive shaft 2512. Teeth 2514 preferably project from top lift outer surface 2502*a*, as shown in FIG. 26. The width or diameter of opening 2502*c* is smaller than the diameter of base 2510, such that top lift insert 2504 is retained in cavity 2502*b* and top lift 2502.

Base 2510 and cavity 2502*b* are preferably shaped to prevent rotation of the base and top lift insert 2504 in top lift 2502. In one embodiment, base 2510 is formed with one or more channels or pockets 2516, and cavity 2502*b* is formed with complementary ribs 2502*d* that are sized, shaped, and positioned to be received in pockets 2516. The insertion of ribs 2502*d* in pockets 2516 restricts the rotation of base 2510 in cavity 2502*b*.

Figure 28B:
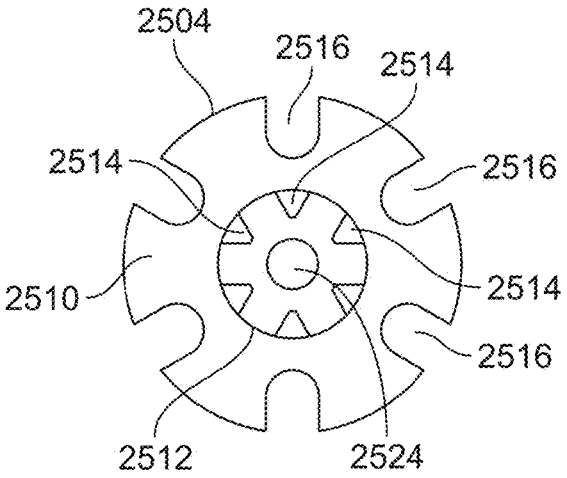
FIG. 28B is a front elevation view of the top lift insert of FIG. 28A
Figure 29:
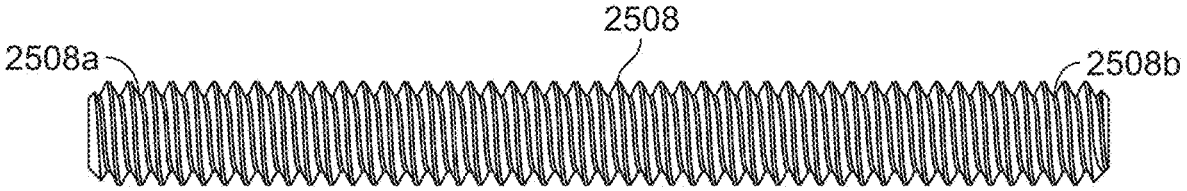
FIG. 29 is a side elevation view of the shaft in the heel system of FIG. 25.
Figure 30:
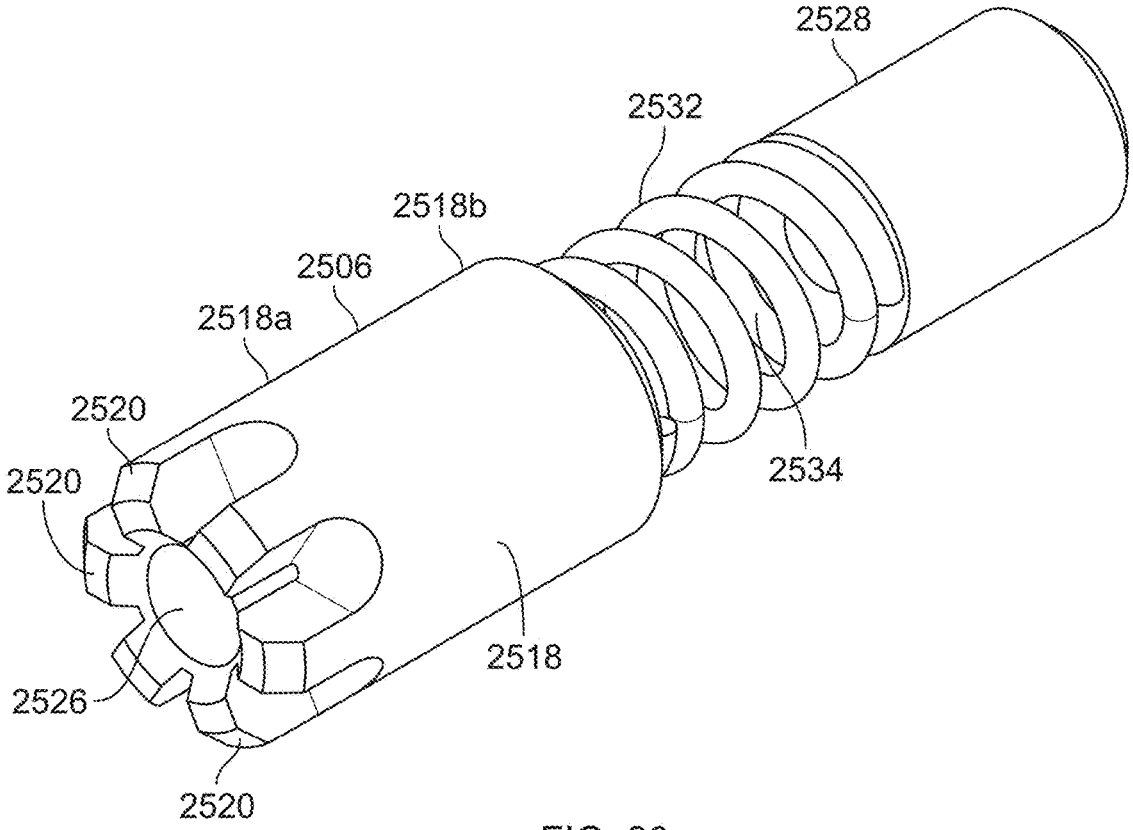
FIG. 30 is an orthographic view of the stop, the spring, and the heel insert of the heel system of FIG. 25.
Figure 31A:
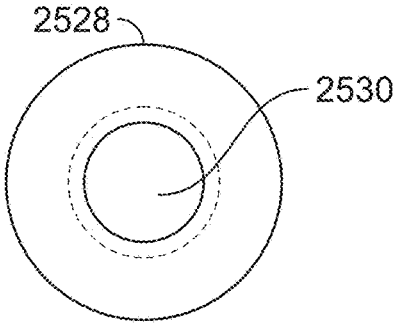
FIG. 31A is a front elevation view of the stop in the heel system of FIG. 25, showing hidden lines.
Figure 31B:
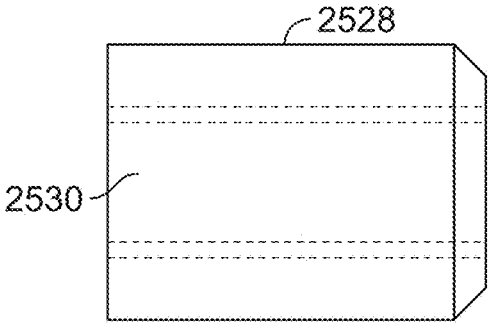
FIG. 31B is a side elevation view of the stop of FIG. 31A, showing hidden lines.
Figure 32A:
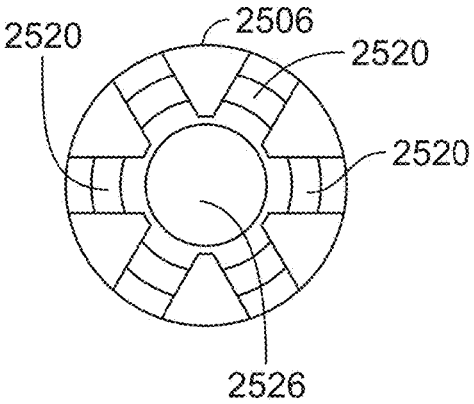
FIG. 32A is a front elevation view of the heel insert in the heel system of FIG. 25.
Figure 32B:
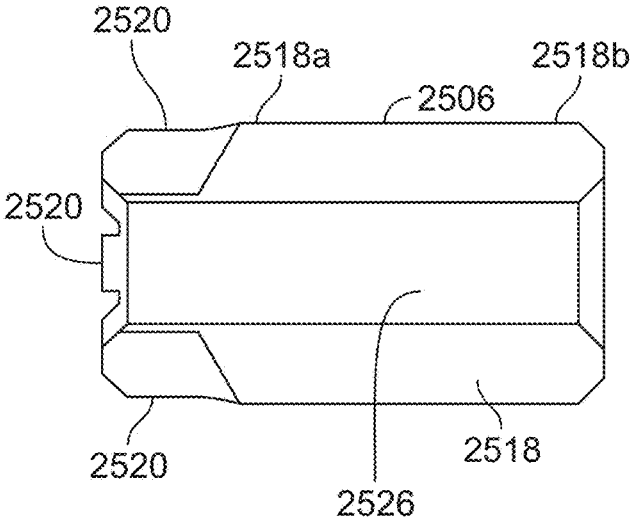
FIG. 32B is a side section view of the heel insert of FIG. 32A.

In one embodiment, heel insert 2506 has a body 2518 with ends 2518*a* and 2518*b*. A plurality of spaced teeth 2520 project from body end 2518*a*, and are preferably formed integrally with body 2518. Teeth 2520 are arranged in a complementary configuration to teeth 2514 of top lift insert 2504, to allow meshing or interlocking engagement of the teeth, as best shown in FIGS. 28B and 32A. In a preferred embodiment, teeth 2512 and teeth 2520 are arranged in complementary circular configurations for interlocking engagement of top lift insert 2504 and heel insert 2506, similar to a pair of meshed crown gears.

Heel insert is coupled to heel 2503. In one embodiment, heel insert 2506 is positioned in heel 2503 and is preferably fixed or anchored and does not move laterally or rotationally relative to the heel. Heel insert 2506 may be fixed to heel 2503 by any of the various means known in the art. In one embodiment, heel 2503 has an opening or bore 2503*b* (e.g., similar to bore 1812 of heel 114). Body 2518 may be generally cone-shaped with a largest width or diameter at end 2518*a* that is slightly larger than the diameter of bore 2503*b*, such that heel insert 2506 may be press-fit or interference-fit inside the heel bore. Adhesive may be applied to body 2518 to fix heel insert 2506 in heel bore 2503*b*.

Top lift insert 2504 and heel insert 2506 are rotatably coupled by shaft 2508. Shaft 2508 has a longitudinal axis with opposite ends 2508*a* and 2508*b*. Top lift insert 2504 is configured to receive shaft end 2508*a*. In one embodiment, top lift insert 2504 has an opening or bore 2524 that is sized and shaped to receive shaft end 2508*a* and couple the top lift insert to shaft end 2508*a* and shaft 2508. In a preferred embodiment, shaft end 2508*a* and opening 2524 are threaded to couple shaft 2508 to top lift insert 2504. Heel insert 2506 has a channel 2526 that extends through body 2518 and is sized and shaped to slidingly receive shaft 2508 and rotatably couple the heel insert to top lift insert 2504.

In operation, shaft 2508 and coupled top lift insert 2504 may rotate in heel insert channel 2526 relative to heel insert 2506. Alternatively, heel insert 2506 may be said to rotate on shaft 2508 relative to top lift insert 2504. Heel insert 2506 is also slidable longitudinally on shaft 2508 to reversibly engage top lift insert teeth 2514 with heel insert teeth 2520. Top lift teeth 2514 and heel insert teeth 2520 preferably project or extend parallel to the longitudinal axis of the shaft to facilitate the meshing and interlocking engagement of the teeth.

Teeth 2514 and 2520 are preferably configured such that top lift insert 2504 cannot rotate relative to heel insert 2506 when teeth 2514 are engaged with teeth 2520. In one embodiment, teeth 2512 and 2520 are configured with a substantially square-tooth profile such that the engagement of teeth 2514 with teeth 2520 defines a pressure angle of about 0°. In contrast to teeth configured as a wedge pattern (e.g., patterns 2000, 2100), the square-tooth profile does not permit teeth 2514 and 2520 to override one another. Consequently, top lift insert 2504 and top lift 2502 cannot rotate relative to heel insert 2506 and heel 2503 when teeth 2514 and 2520 are engaged.

The engagement of teeth 2514 with teeth 2520 preferably aligns the respective outer profiles of the top lift 2502 and heel 2503—e.g., where the top lift and heel have matching irregular outer profiles or contours, as in FIGS. 20 and 21. For example, in the embodiments of FIGS. 28 and 32, top lift insert 2504 and heel insert 2506 each have six regularly spaced teeth 2514 and 2520 in complementary circular configurations. The meshing or interlocking engagement of teeth 2514 and 2520 is only permitted in six possible alignments of top lift insert 2504 and heel insert 2506, and therefore, only six possible alignments of top lift 2502 and heel 2503. In one embodiment, at least one alignment of top lift insert 2504 and heel insert 2506 corresponds to the alignment of the outer profiles of the top lift 2502 and heel 2503. Those of skill in the art will appreciate that complementary teeth 2514 and 2520 may be configured such that there are fewer possible alignments. Alternatively, complementary teeth 2514 and 2520 may have only one possible orientation of top lift insert 2504 relative to heel insert 2506 that permits the engagement of teeth 2514 with teeth 2520 and which corresponds to the alignment of the outer profiles of the top lift 2502 and heel 2503.

Top lift 2502 and heel 2503 are preferably coupled together in flush contact—e.g., as shown in FIG. 26, with top lift outer surface 2502*a* in flush contact with the outer surface 2503*a* at the top of heel 2503. In one embodiment, top lift insert 2504 is coupled to top lift 2502 (e.g., positioned in cavity 2502*b*) such that substantially only teeth 2514 of the top lift insert project from top lift outer surface 2502*a*. Heel insert 2506 is coupled to heel 2503 (e.g., positioned in heel bore 2503*b*) such that teeth 2520 are substantially flush with heel outer surface 2503*a*. When teeth 2514 are engaged with teeth 2520, top lift outer surface

2502*a* and heel outer surface 2503*a* are in substantially flush contact with each other. Those of skill in the art will appreciate that heel system 2500 may have the opposite configuration—i.e. with teeth 2514 flush with top lift outer surface 2502*a*, and only teeth 2520 of heel insert 2506 projecting from heel outer surface 2503*a*.

In one embodiment, heel system 2500 includes a stop 2528 that is positioned in heel 2503 and configured to receive shaft end 2508*b*. As shown in FIG. 26, stop 2528 is positioned in heel bore 2503*b*, and preferably has a width or diameter that is smaller than the diameter of the heel bore, such that the stop may travel or slide longitudinally within the heel bore, as shown by arrow E. Stop 2528 has an opening or bore 2530 that extends through the stop and is sized and shaped to receive shaft end 2508*b* and couple the stop to shaft end 2508*b* and shaft 2508. Stop 2528 has a width or diameter that is larger than the heel insert bore 2524, such that the stop and shaft end 2508*b* cannot be withdrawn from heel insert 2506, and the heel insert and top lift insert 2504 are coupled by shaft 2508.

In a preferred embodiment, stop bore 2530 and shaft end 2508*b* are threaded to couple shaft end 2508*b* to the stop bore. The separation between top lift insert 2504 and stop 2528 on shaft 2508 is adjustable (e.g., lengthened or shortened) by the threaded rotation of shaft end 2508*b* in stop bore 2530. Adjusting the separation between top lift insert 2504 and stop 2528 also adjusts (lengthens or shortens) the range of sliding movement between the top lift insert and heel insert 2506 on shaft 2508.

In one embodiment, heel system 2500 includes a compressible elastic member 2532 positioned in heel 2503 between heel insert 2506 and stop 2528, to bias the stop away from the heel insert and bias top lift insert 2504 toward the heel insert for interlocking engagement of teeth 2514 and 2520. Compressible elastic member 2532 is sized and shaped to be received in heel bore 2503*b*, but has an outer width or diameter that is larger than heel insert channel 2526, to prevent the withdrawal of the compressible elastic member from the heel bore through the heel insert channel. In one embodiment, compressible elastic member 2532 has a channel or opening 2534 that is sized and shaped to receive shaft 2508. In a preferred embodiment, compressible elastic member 2532 is a coil spring having an opening 2534 through the center of the coil that is sized and shaped to receive shaft 2508. Stop 2528 has an outer width or diameter that is larger than opening 2534, to ensure that compressible elastic member or spring 2532 is secured between heel insert 2506 and the stop.

Top lift insert 2504, heel insert 2506, shaft 2508, stop 2528, and compressible elastic member 2332 comprise a heel assembly for coupling top lift 2502 and heel 2503. In operation, stop 2528 is first inserted into heel bore 2503*b*, compressible elastic member 2532 is next inserted into the heel bore, and then heel insert 2506 is positioned and fixed in the heel bore. Shaft 2508 is coupled to top lift insert 2504 at shaft end 2508*a*. Shaft end 2508*b* is then inserted through heel insert channel 2526, through compressible elastic member opening 2534, and is received in stop bore 2530 to couple shaft 2508 to stop 2526. Top lift 2502 and top lift insert 2504 are manually pulled away from heel insert 2506 and heel 2503. Top lift insert 2504 is coupled to stop 2528 by shaft 2508, such that the movement of the top lift insert away from heel insert 2506 causes the stop to move toward the heel insert and compresses compressible elastic member 2532. Top lift insert 2504 is rotated to align teeth 2514 for engagement with teeth 2520, and align the outer profiles of the top lift 2502 and heel 2503. Top lift 2502 and top lift insert 2504 are then released, and compressible elastic member 2532 is allowed to expand and urge teeth 2514 toward engagement with teeth 2520. The expansion of compressible elastic member 2532 urges stop 2528 away from heel insert 2506, and causes top lift insert 2504 and teeth 2514 to move toward the heel insert and teeth 2520. Once teeth 2514 and 2520 are engaged, top lift 2502 cannot rotate relative to heel 2503, which prevents the inadvertent misalignment of the top lift and heel during normal use. Shaft 2508 may be rotated in stop bore 2530 to lengthen or shorten the separation between the top lift insert and stop 2528 on shaft 2508, and adjust the compression of elastic member 2532 urging top lift insert 2504 and top lift 2502 toward heel insert 2506 and heel 2503.

The reverse process is used to uncouple top lift 2502 from heel 2503, such as for replacement of a worn top lift. Top lift 2502 and top lift insert 2504 are manually pulled away from heel insert 2506 and heel 2503, to disengage teeth 2514 and 2520. Once teeth 2514 and 2520 are disengaged, top lift insert 2504 may be rotated to lengthen the separation between the top lift insert and stop 2528 on shaft 2508, and uncouple the shaft from the stop. Shaft 2508 may then be withdrawn from compressible elastic member opening 2534 and heel insert channel 2526, and removed from heel bore 2503*b* to uncouple top lift 2502 from heel 2503.

Heel system 2500 is preferably sized for installation in the heel of a conventional high heel shoe. In one embodiment, top lift insert base 2510 is disk-shaped with a diameter of about 0.25 inches, and a height of about 0.06 inches. Six regularly spaced pockets are formed about the circumference of base 2510, each pocket having an opening at the perimeter of the base with a width of about 0.039 inches and a depth of about 0.046 inches. Shaft 2512 is generally cylinder-shaped with a diameter of about 0.113 inches, and projects from base 2510 at a height of about 0.059 inches. Six teeth 2514 are arranged in a circle and project from the end of shaft 2512 with a tooth height of about 0.031 inches. Teeth 2514 are regularly spaced with a spacing of about 0.034 inches between teeth at the circumference of shaft 2512.

Heel insert 2506 has a generally cylinder-shaped body 2518 with an outer diameter of about 0.11 inches, and a height of about 0.197 inches (including the height of teeth 2520). Six teeth 2520 are arranged in a circle and are formed integrally with body 2518, with a height of about 0.0.38 inches, and a width of about 0.022 inches. Teeth 2520 are regularly spaced with a spacing between teeth of about 0.035 inches at the circumference of body 2518.

Stop 2528 is generally cylinder-shaped with an outer diameter of about 0.086 inches and a height of about 0.118 inches.

Shaft 2508 is a cylinder-shaped shaft having a length of about 0.472 inches, and threaded with a major diameter of about 1.2 mm and a pitch of about 0.25 mm (M1.2 0.25). Top lift insert opening 2524 and stop opening 2530 are both threaded, and sized and shaped to receive shaft 2508. In one embodiment, openings 2524 and 2530 have a threaded bore outside diameter of about 0.037 inches. Heel insert channel 2526 has a diameter that is slightly larger than shaft 2508, to allow the shaft to slide within the channel. In one embodiment, channel 2526 has a diameter of about 0.047 inches. When shaft 2508 is received in top lift insert opening 2524, the combined length or height of the assembled top lift insert 2504 and shaft 2508 is about 0.472 inches. The combined length or height of the assembled heel insert 2506, the compressible elastic member 2532, and stop 2528 is about 0.44 inches.

Figure 33:
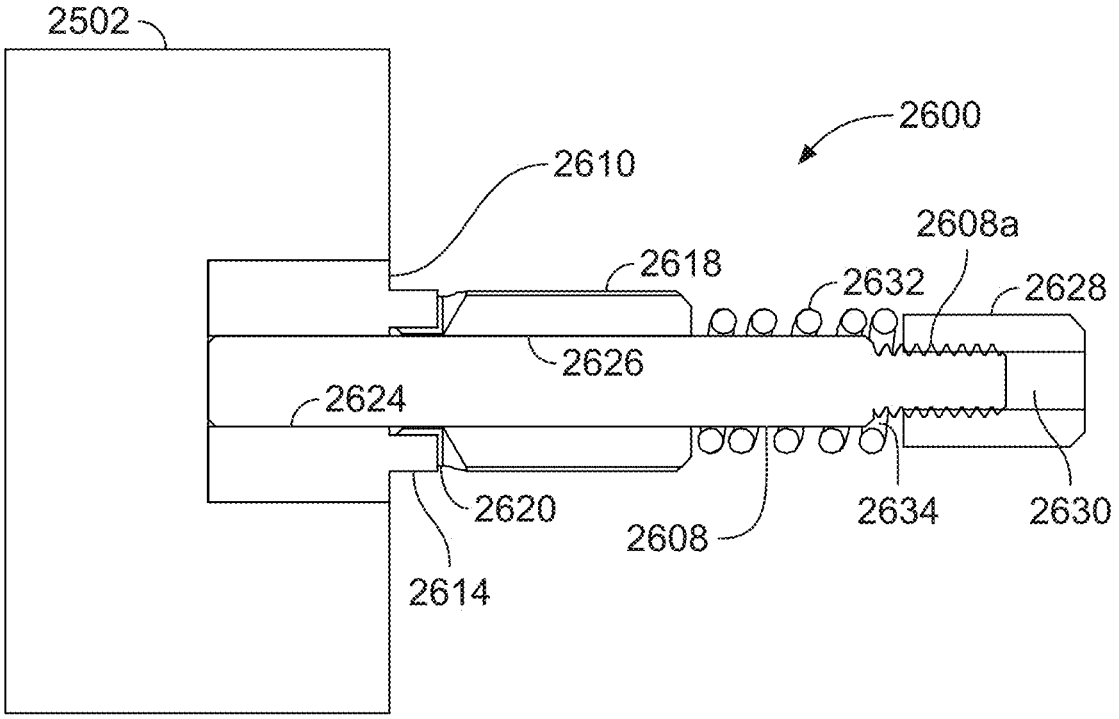
FIG. 33 is a side section view of an alternative embodiment of a heel system and top lift.
Figure 34:
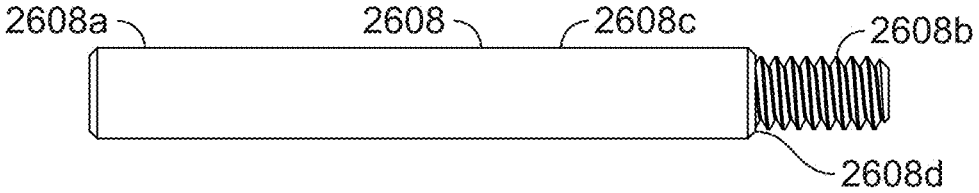
FIG. 34 is a side elevation view of the shaft of the heel system of FIG. 33.

Referring to FIGS. 33-35, an alternative embodiment of a heel system 2600 is shown. Heel system 2600 comprises a top lift insert 2604, a heel insert 2606, a shaft 2608, a compressible elastic member 2632, and a stop 2628, which are similar to previously described heel system 2500. Top lift insert 2604 is secured in a top lift 2502, and heel insert 2606 is secured to a heel (not shown).

Top lift insert 2604 and heel insert 2606 respectively have complementary teeth 2614 and 2620 that are configured to allow meshing or interlocking engagement of the teeth. Top lift insert 2604 and heel insert 2606 are rotatably and slidingly coupled by a shaft 2608, that has opposite ends 2608*a* and 2608*b*. Top lift insert 2604 has an opening or bore 2624 that is sized and shaped to receive shaft end 2608*a* and couple the top lift insert to the shaft. Heel insert 2606 has a channel 2626 that extends through the heel insert and is sized and shaped to slidingly receive shaft 2608. Stop 2628 is positioned in the heel and has an opening or bore 2630 that is sized and shaped to receive shaft end 2608*b* and couple the stop to the shaft. Stop 2628 prevents withdrawal of the shaft from heel insert channel 2626. Compressible elastic member 2632 is a coil spring, that is positioned in the heel between heel insert 2606 and stop 2628. Coil spring 2632 has an opening 2634 through the center of the coil, that is sized and shaped to slidingly receive shaft 2608.

Coil spring 2632 biases stop 2628 away from heel insert 2606, and urges top lift insert teeth 2614 toward engagement with heel insert teeth 2620. Shaft 2608 and stop opening 2630 may have complementary threads that allow rotational adjustment of the separation between top lift insert 2604 and stop 2628 on shaft 2608. Lengthening or shortening the separation between top lift insert 2604 and stop 2628, reduces or increases the compression of coil spring 2632 and the force biasing top lift insert 2604 toward engagement with heel insert 2606.

Those of skill in the art will appreciate that overrotation of shaft 2608 in threaded stop opening 2630 may reduce the separation between top lift insert 2604 and stop 2628, and increase the compression of coil spring 2632 to the point where the force biasing top lift insert 2604 toward engagement with heel insert 2606 cannot easily be overcome, and top lift insert teeth 2614 cannot be removed from engagement with heel insert teeth 2620. Shaft 2608 is preferably configured to prevent overrotation and ensure the reversible engagement of top lift insert teeth 2614 with heel insert teeth 2620. In one embodiment, at least a portion of the body 2608*c* of shaft 2608 has a width or diameter that is larger than the width or diameter of stop opening 2630, and is preferably unthreaded. Threaded shaft end 2608*b* has a width or diameter that is smaller than shaft body 2608*c*, and is sized and shaped to be received in complementary threaded stop opening 2630. The larger diameter of shaft body 2608*c* forms a shoulder 2608*d* between the shaft body and threaded end 2608*b*, that is larger than the diameter of stop opening 2630. Shoulder 2608*d* forms a stop that limits the rotation of shaft 2608 in threaded stop opening 2630, and prevents further shortening of the separation between top lift insert 2604 and stop 2628.

Shoulder 2608*c* is positioned on shaft 2608 to ensure a minimum separation between top lift insert 2604 and stop 2628, that allows disengagement of top lift insert teeth 2614 from heel insert teeth 2620. In a preferred embodiment, shaft 2608 has a length of about 0.52 inches (13.2 mm), which includes threaded end 2608*b* having a length of about 0.087 inches (2.2 mm). Shaft body 2608*c* has a diameter of about 0.059 inches (1.5 mm), and threaded end 2608*b* has a major diameter of about 1.2 mm and a pitch of about 0.25 mm (M1.2 0.25). Shaft end 2608*a* is preferably unthreaded and has the diameter of shaft body 2608*c*.

Top lift insert 2604 is similar in size and shape to top lift insert 2504, but has an opening 2624 with a diameter of about 0.059 inches (1.5 mm) to receive shaft body 2608*c*. Heel insert 2606 is similar in size and shape to heel insert 2506, but has a channel 2626 with a diameter of about 0.59 inches (1.5 mm) to receive shaft body 2608*c*. Stop 2628 is similar in size and shape to stop 2538.

Figure 35A:
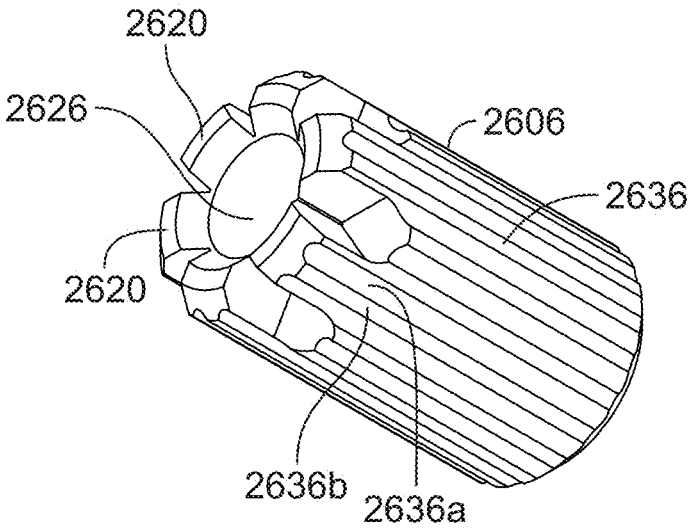
FIG. 35A is an orthographic view of the heel insert of the heel system of FIG. 33.
Figure 35B:
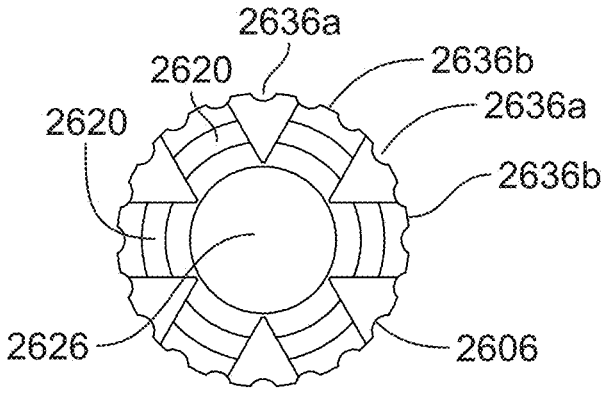
FIG. 35B is a front elevation view of the heel insert of FIG. 35A.

The outer surface of heel insert 2606 may be knurled or otherwise patterned to improve retention of the heel insert in a heel bore (not shown), such as by interference fit. For example, heel insert 2606 may have an outer surface that is knurled with alternating grooves and ridges. In the embodiment of FIGS. 35A and 35B, heel insert 2606 is generally cylindrical with an outer surface 2636 having a diameter of about 0.118 inches (3 mm). Heel insert outer surface 2636 has series of regularly spaced longitudinal grooves 2636*a* that form longitudinal ridges 2636*b* therebetween. In a preferred embodiment, heel insert outer surface 2636 has 20 regularly spaced longitudinal grooves that are approximately semi-cylindrical in shape, having a radius of about 0.006 inches (0.2 mm) and a depth of about 0.003 inches (0.08 mm).

The above description only provides an explanation of the preferred embodiments of the present disclosure and the technical principles used. It should be appreciated by those skilled in the art that the inventive scope of the present disclosure is not limited to the technical solutions formed by the particular combinations of the above-described technical features. The inventive scope should also cover other technical solutions formed by any combinations of the above-described technical features or equivalent features thereof without departing from the concept of the disclosure. Technical schemes formed by the above-described features being interchanged with, but not limited to, technical features with similar functions disclosed in the present disclosure are examples.

The invention claimed is:

1. A heel system for coupling a heel and a top lift of a footwear, the heel system comprising:

a top lift insert coupled to the top lift, and comprising a plurality of spaced first teeth;

a heel insert coupled to the heel, and comprising a plurality of spaced second teeth, the first teeth and second teeth arranged in complementary configurations; and a shaft rotatably coupling the top lift insert and the heel insert;

wherein the heel insert is slidable on the shaft to reversibly engage the first teeth with the second teeth, and the top lift insert cannot rotate relative to the heel insert when the first teeth are engaged with the second teeth.

2. The heel system of claim 1, wherein the top lift and heel have matching irregular outer profiles, and wherein the engagement of the first teeth with the second teeth aligns the outer profiles of the top lift and heel.

3. The heel system of claim 1, wherein the first teeth and second teeth are arranged in complementary circular configurations.

4. The heel system of claim 1, wherein the shaft has a longitudinal axis, and the first teeth and second teeth extend parallel to the longitudinal axis of the shaft.

5. The heel system of claim 1, wherein the first and second teeth have a substantially square-tooth profile.

6. The heel system of claim 1, wherein the top lift has a top lift surface and the heel has a heel surface, and wherein the top lift surface and heel surface are in substantially flush contact with each other when the first teeth are engaged with the second teeth.

7. The heel system of claim 6, wherein the first teeth project from the top lift surface, and the second teeth are substantially flush with the heel surface.

8. The heel system of claim 1, wherein the shaft has opposite shaft first and second ends, and the top lift insert is coupled to the first shaft end;

wherein the heel insert is positioned in the heel, and comprises a channel, and heel insert first and second ends, the channel extending through the heel insert and sized and shaped to slidably receive the shaft, and the second teeth are positioned at the heel insert first end; and further comprising a stop positioned in the heel and coupled to the shaft second end.

9. The heel system of claim 8, further comprising a compressible elastic member positioned in the heel between the heel insert second end and the stop, the compressible elastic member biasing the stop away from the heel insert and urging the first teeth toward engagement with the second teeth.

10. The heel system of claim 8, wherein the shaft first and second ends are threaded, the top lift insert has a first threaded bore configured to receive the first shaft end, the stop has a second threaded bore configured to receive the second shaft end; and wherein the separation between the top lift insert and the stop is adjustable by rotation of the shaft second end in the second bore.

11. The heel system of claim 10, wherein the shaft further comprises a shaft stop that limits the rotation of the shaft second end in the second bore.

12. The heel system of claim 1, wherein the heel insert is coupled to the heel by interference fit, and the heel insert has an outer surface that is patterned to improve coupling to the heel.

13. A heel system for a footwear, comprising:

a top lift having a top lift cavity;

a heel having a heel bore; and a heel assembly coupling the top lift and the heel, the heel assembly comprising:

a shaft having opposite shaft first and second ends;

a top lift insert coupled to the top lift, and comprising a base received in the top lift cavity, a top lift insert bore sized and shaped to receive the shaft first end, and a plurality of spaced first teeth;

a heel insert positioned in the heel bore, and comprising a channel, heel insert first and second ends, and a plurality of spaced second teeth, the channel extending through the heel insert and sized and shaped to slidably receive the shaft, and the second teeth positioned at the heel insert first end, the first teeth and second teeth arranged in complementary configurations;

a stop positioned in the heel bore and having a stop bore sized and shaped to receive the shaft second end; and a compressible elastic member positioned in the heel between the heel insert second end and the stop, the compressible elastic member biasing the stop away from the heel insert and urging the first teeth toward engagement with the second teeth;

wherein the top lift and heel are rotatably coupled by the shaft, the heel insert is slidable on the shaft to reversibly engage the first teeth with the second teeth, and the top lift cannot rotate relative to the heel when the first teeth are engaged with the second teeth.

14. The heel system of claim 13, wherein the top lift and heel have matching irregular outer profiles, and wherein the engagement of the first teeth with the second teeth aligns the outer profiles of the top lift and heel.

15. The heel system of claim 13, wherein the first and second teeth are arranged in complementary circular configurations.

16. The heel system of claim 13, wherein the shaft has a longitudinal axis, and the first teeth and second teeth project parallel to the longitudinal axis of the shaft.

17. The heel system of claim 13, wherein the first and second teeth have a substantially square-tooth profile.

18. The heel system of claim 13, wherein the top lift has a top lift surface and the heel has a heel surface, and wherein the top lift surface and heel surface are in substantially flush contact with each other when the first teeth are engaged with the second teeth.

19. The heel system of claim 18, wherein the first teeth project from the top lift surface, and the second teeth are substantially flush with the heel surface.

20. The heel system of claim 13, wherein the shaft second end is threaded, the stop bore is threaded to receive the shaft second end, and the separation between the top lift insert and the stop is adjustable by rotation of the shaft second end in the stop bore.

* * * * *